US009822547B2

(12) United States Patent
Bizzarri et al.

(10) Patent No.: US 9,822,547 B2
(45) **Date of Patent: *Nov. 21, 2017**

(54) RAIL SYSTEM AND METHOD FOR ASSEMBLY

(71) Applicant: CPG International LLC, Scranton, PA (US)

(72) Inventors: Paul M. Bizzarri, Mason, OH (US); Chip Herr, Columbus, OH (US); John M. Previte, Dublin, OH (US); Kevin T. Burt, Columbus, OH (US); William G. Taylor, Columbus, OH (US); Matthew T. Fenneman, Gahanna, OH (US); Jeffrey R. Burr, Loveland, OH (US); Timothy C. Rothwell, Dublin, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,412

(22) Filed: May 14, 2015

(65) Prior Publication Data

US 2015/0247341 A1 Sep. 3, 2015

Related U.S. Application Data

(63) Continuation of application No. 13/461,496, filed on May 1, 2012, now Pat. No. 9,611,650, which is a (Continued)

(51) Int. Cl.
*E04H 17/00* (2006.01)
*E04H 17/14* (2006.01)
(Continued)

(52) U.S. Cl.
CPC ..... *E04H 17/1421* (2013.01); *E04F 11/181* (2013.01); *E04H 17/20* (2013.01);
(Continued)

(58) Field of Classification Search
CPC ..... E04H 17/1421; E04H 17/20; E04H 2017/1482; E04H 2017/1473
See application file for complete search history.

(56) References Cited

U.S. PATENT DOCUMENTS 1,087,576 A 2/1914 Fernald
2,072,687 A 3/1937 Robinson
(Continued)

FOREIGN PATENT DOCUMENTS

CA 1213767 A 11/1986
CA 2153659 A1 5/1995
(Continued)

OTHER PUBLICATIONS

Redbook, For Resin Producers, Formulators, and Compounders, Plastics Compounding, 1992/93, 2 pages.
(Continued)

*Primary Examiner* — Victor MacArthur
(74) *Attorney, Agent, or Firm* — Standley Law Group LLP

(57) ABSTRACT

A rail system that may be comprised of various components such as an upper rail, support rail, bottom rail, squash blocks, balusters, post covers, and ancillary components, such as post skirts and caps. In one exemplary embodiment, the rail system may be uniquely designed to accommodate perpendicular and angled installations (e.g., both in the horizontal and vertical planes). Furthermore, in another exemplary embodiment, the rail system may be easily assembled such that the support hardware is substantially hidden from view after installation, thereby enhancing the appearance of the railing.

24 Claims, 14 Drawing Sheets

Related U.S. Application Data continuation of application No. 12/831,064, filed on Jul. 6, 2010, now Pat. No. 8,167,275, which is a continuation of application No. 11/292,269, filed on Nov. 30, 2005, now abandoned.

(51) Int. Cl.
*E04F 11/18* (2006.01)
*E04H 17/20* (2006.01)

(52) U.S. Cl.
CPC ..... *E04H 2017/006* (2013.01); *E04H 2017/1473* (2013.01); *E04H 2017/1482* (2013.01)

(56) References Cited

U.S. PATENT DOCUMENTS 2,153,316 A 4/1939 Sherrard et al.
2,156,160 A 4/1939 Olson et al.
2,188,396 A 1/1940 Semon
2,306,274 A 12/1942 Meiler
2,316,283 A 4/1943 Piperoux et al.
2,451,558 A 10/1948 Schlosser
2,489,373 A 11/1949 Gilman
2,519,442 A 8/1950 Delorme et al.
2,535,373 A 12/1950 Shearer et al.
2,558,378 A 6/1951 Petry
2,634,534 A 4/1953 Brown
2,635,976 A 4/1953 Meiler et al.
2,680,102 A 6/1954 Becher
2,759,837 A 8/1956 Roberts
2,789,903 A 4/1957 Lukman et al.
2,808,233 A 10/1957 Spescha
2,932,488 A 4/1960 Dotson
2,935,763 A 5/1960 Newman et al.
D189,447 S 12/1960 Attwood
2,976,164 A 3/1961 Glab
3,031,217 A 4/1962 Tinnerman
3,136,530 A 6/1964 Case
D199,024 S 9/1964 Huret
D200,702 S 3/1965 Huret
3,287,480 A 11/1966 Wechsler et al.
3,308,218 A 3/1967 Wiegand et al.
3,309,444 A 3/1967 Schueler
D210,519 S 3/1968 Kusel
3,420,505 A 1/1969 Jefferys
3,463,456 A 8/1969 Walker
3,471,128 A 10/1969 Jeffreys
3,492,388 A 1/1970 Inglin-Knuse
3,493,527 A 2/1970 Schueler
3,498,589 A 3/1970 Murdock
3,533,906 A 10/1970 Reiniger
3,562,373 A 2/1971 Logrippo
3,596,880 A 8/1971 Greenberg
3,645,939 A 2/1972 Gaylord
3,671,615 A 6/1972 Price
3,707,276 A 12/1972 Francis et al.
3,756,567 A 9/1973 Murdock
3,769,380 A 10/1973 Wiley
3,804,374 A 4/1974 Thom
3,852,387 A 12/1974 Bortnick et al.
3,858,850 A * 1/1975 Maxcy et al. ..... 256/22
3,864,201 A 2/1975 Susuki et al.
3,867,493 A 2/1975 Seki
3,878,143 A 4/1975 Baumann et al.
3,879,017 A 4/1975 Maxcy et al.
3,879,505 A 4/1975 Boutillier et al.
3,888,810 A 6/1975 Shinomura
3,899,559 A 8/1975 Johnanson et al.
3,908,902 A 9/1975 Collins et al.
3,918,686 A * 11/1975 Knott et al. ..... 256/59
3,922,328 A 11/1975 Johnson
3,931,384 A 1/1976 Forquer et al.
3,943,079 A 3/1976 Hamed
3,944,178 A 3/1976 Greenwood
3,954,555 A 5/1976 Kole et al.
3,955,800 A * 5/1976 Russo ..... 256/59
3,956,541 A 5/1976 Pringle
3,956,555 A 5/1976 McKean
3,969,459 A 7/1976 Fremont et al.
4,005,035 A 1/1977 Deaver
4,005,162 A 1/1977 Bucking
4,012,348 A 3/1977 Chelland et al.
4,014,520 A 3/1977 Walters
4,016,232 A 4/1977 Pringle
4,016,233 A 4/1977 Pringle
4,018,722 A 4/1977 Baker
4,027,855 A 6/1977 Lauzier
4,029,831 A 6/1977 Daunheimer
4,045,603 A 8/1977 Smith
4,048,101 A 9/1977 Nakamachi et al.
4,056,591 A 11/1977 Goettler et al.
4,058,580 A 11/1977 Flanders
4,071,479 A 1/1978 Broyde et al.
4,071,494 A 1/1978 Gaylord
4,073,477 A 2/1978 Walters
4,081,582 A 3/1978 Butterworth et al.
4,091,153 A 5/1978 Holman
4,097,648 A 6/1978 Pringle
4,100,325 A 7/1978 Summers et al.
4,101,050 A 7/1978 Buckler et al.
4,102,106 A 7/1978 Golder et al.
4,107,110 A 8/1978 Lachowicz et al.
4,115,497 A 9/1978 Halmo et al.
4,129,132 A 12/1978 Butterworth et al.
4,133,930 A 1/1979 Wright et al.
D251,451 S 3/1979 Toder
4,145,389 A 3/1979 Smith
4,157,415 A 6/1979 Lindenberg
4,168,251 A 9/1979 Schinzel et al.
4,178,411 A 12/1979 Cole et al.
4,181,764 A 1/1980 Totten
4,187,352 A 2/1980 Klobbie
4,191,798 A 3/1980 Schumacher et al.
4,192,839 A 3/1980 Hayashi et al.
4,198,363 A 4/1980 Noel
4,203,876 A 5/1980 Dereppe et al.
4,228,116 A 10/1980 Colombo et al.
4,239,679 A 12/1980 Rolls et al.
4,241,125 A 12/1980 Canning et al.
4,241,133 A 12/1980 Lund et al.
4,244,903 A 1/1981 Schnause
4,248,743 A 2/1981 Goettler
4,248,820 A 2/1981 Haataja
4,250,222 A 2/1981 Mavel et al.
4,260,277 A 4/1981 Daniels
4,263,184 A 4/1981 Leo et al.
4,263,196 A 4/1981 Schumacher et al.
4,272,577 A 6/1981 Lyng
4,273,688 A 6/1981 Porzel et al.
4,277,428 A 7/1981 Luck et al.
4,290,988 A 9/1981 Nopper et al.
4,297,408 A 10/1981 Stead et al.
4,303,019 A 12/1981 Haataja et al.
4,305,901 A 12/1981 Prince et al.
4,317,765 A 3/1982 Gaylord
4,323,625 A 4/1982 Coran et al.
4,351,873 A 9/1982 Davis
4,352,485 A 10/1982 Basey
4,376,144 A 3/1983 Goettler
4,382,108 A 5/1983 Carroll et al.
4,382,758 A 5/1983 Nopper et al.
4,393,020 A 7/1983 Li et al.
4,414,267 A 11/1983 Coran et al.
4,420,351 A 12/1983 Lussi et al.
4,421,302 A 12/1983 Grimm et al.
4,430,468 A 2/1984 Schumacher
4,440,708 A 4/1984 Haataja et al.
4,451,025 A 5/1984 Spera
4,480,061 A 10/1984 Coughlin et al.
4,480,573 A 11/1984 Barbour
4,481,701 A 11/1984 Hewitt
4,491,553 A 1/1985 Yamada et al.
4,503,115 A 3/1985 Hemels et al.

(56) References Cited

U.S. PATENT DOCUMENTS 4,505,869 A 3/1985 Nishibori
4,506,037 A 3/1985 Suzuki et al.
4,508,595 A 4/1985 Gasland
4,518,552 A 5/1985 Matsuo et al.
4,523,735 A 6/1985 Beck et al.
4,562,218 A 12/1985 Fornadel et al.
4,594,372 A 6/1986 Natov et al.
4,597,928 A 7/1986 Terentiev et al.
4,610,900 A 9/1986 Nishibori
4,645,631 A 2/1987 Hegenstaller et al.
4,659,754 A 4/1987 Edwards et al.
4,663,225 A 5/1987 Farley et al.
4,686,251 A 8/1987 Ostermann et al.
4,687,793 A 8/1987 Motegi et al.
4,708,623 A 11/1987 Aoki et al.
D293,718 S 1/1988 Poma
4,717,742 A 1/1988 Beshay
4,722,514 A 2/1988 Pettit
4,734,236 A 3/1988 Davis
4,737,532 A 4/1988 Fujita et al.
4,744,930 A 5/1988 Twist et al.
4,746,688 A 5/1988 Bistak et al.
4,769,109 A 9/1988 Tellvik et al.
4,769,274 A 9/1988 Tellvik et al.
4,783,493 A 11/1988 Motegi et al.
4,789,604 A 12/1988 van der Hoeven
4,790,966 A 12/1988 Sandberg et al.
4,791,020 A 12/1988 Kokta
4,800,214 A 1/1989 Waki et al.
4,801,495 A 1/1989 van der Hoeven
4,818,590 A 4/1989 Prince et al.
4,818,604 A 4/1989 Tock
4,820,749 A 4/1989 Beshay
4,833,194 A 5/1989 Kuan et al.
4,844,766 A 7/1989 Held
4,851,458 A 7/1989 Hopperdietzel
4,865,788 A 9/1989 Davis
4,889,673 A 12/1989 Takimoto
4,894,192 A 1/1990 Warych
4,915,764 A 4/1990 Miani
4,927,572 A 5/1990 van der Hoeven
4,927,579 A 5/1990 Moore
4,935,182 A 6/1990 Ehner et al.
4,960,548 A 10/1990 Ikeda et al.
4,968,463 A 11/1990 Levasseur
4,973,440 A 11/1990 Tamura et al.
4,978,489 A 12/1990 Radvan et al.
4,988,478 A 1/1991 Held
4,995,591 A 2/1991 Humphrey et al.
5,002,713 A 3/1991 Palardy et al.
5,008,310 A 4/1991 Beshay
5,008,975 A 4/1991 Wang et al.
5,009,586 A 4/1991 Pallmann
5,029,818 A 7/1991 Katz
5,049,334 A 9/1991 Bach
5,055,247 A 10/1991 Ueda et al.
5,057,167 A 10/1991 Gersbeck
5,064,592 A 11/1991 Ueda et al.
5,075,057 A 12/1991 Hoedl
5,075,359 A 12/1991 Castagna et al.
5,078,937 A 1/1992 Eela
5,082,605 A 1/1992 Brooks et al.
5,087,400 A 2/1992 Theuveny
5,088,910 A 2/1992 Goforth et al.
5,091,436 A 2/1992 Frisch et al.
5,096,046 A 3/1992 Goforth et al.
5,096,406 A 3/1992 Brooks et al.
5,110,663 A 5/1992 Nishiyama et al.
5,110,843 A 5/1992 Bries et al.
5,120,776 A 6/1992 Raj et al.
5,145,891 A 9/1992 Yasukawa et al.
5,151,238 A 9/1992 Earl et al.
5,153,241 A 10/1992 Beshay
5,160,211 A 11/1992 Gilb
5,160,784 A 11/1992 Shmidt et al.
5,165,941 A 11/1992 Hawley
5,190,268 A 3/1993 Espinueva
5,192,056 A 3/1993 Espinueva
5,194,461 A 3/1993 Bergquist et al.
D335,353 S 5/1993 Baker
5,218,807 A 6/1993 Fulford
5,219,634 A 6/1993 Aufderhaar
5,230,186 A 7/1993 Hammonds et al.
5,234,652 A 8/1993 Woodhams et al.
5,258,232 A 11/1993 Summers et al.
5,272,000 A 12/1993 Chenoweth et al.
5,276,082 A 1/1994 Forry et al.
5,284,710 A 2/1994 Hartley et al.
5,288,772 A 2/1994 Hon
5,302,634 A 4/1994 Mushovic
5,350,156 A 9/1994 Cote et al.
5,356,697 A 10/1994 Jonas
5,369,147 A 11/1994 Mushovic
5,387,381 A 2/1995 Saloom
5,393,536 A 2/1995 Brandt et al.
5,404,683 A 4/1995 Hammonds et al.
5,406,768 A 4/1995 Giuseppe et al.
5,413,745 A 5/1995 Andersson
D358,982 S 6/1995 Bosgoed
5,422,170 A 6/1995 Iwata et al.
5,423,933 A 6/1995 Horian
5,435,954 A 7/1995 Wold
5,441,801 A 8/1995 Deaner et al.
5,443,244 A 8/1995 Gibbs
5,443,887 A 8/1995 Nakao
5,458,834 A 10/1995 Faber et al.
5,474,722 A 12/1995 Woodhams
5,480,602 A 1/1996 Nagaich
5,486,553 A 1/1996 Deaner et al.
5,497,594 A 3/1996 Giuseppe et al.
5,505,900 A 4/1996 Suwanda et al.
5,516,472 A 5/1996 Laver
5,518,677 A 5/1996 Deaner et al.
5,532,065 A 7/1996 Gubitz et al.
5,537,789 A 7/1996 Minke et al.
5,538,777 A 7/1996 Pauley et al.
5,539,027 A 7/1996 Deaner et al.
5,544,866 A 8/1996 Dye
D375,573 S 11/1996 Andres
5,573,227 A 11/1996 Hemauer et al.
5,574,094 A 11/1996 Malucelli et al.
5,576,374 A 11/1996 Betso et al.
5,585,155 A 12/1996 Heikkila et al.
5,593,625 A 1/1997 Riebel et al.
5,601,279 A 2/1997 Schwartz et al.
5,624,616 A 4/1997 Brooks
5,649,688 A 7/1997 Baker
5,683,074 A 11/1997 Purvis et al.
5,695,874 A 12/1997 Deaner et al.
5,711,349 A 1/1998 Wissmann
5,713,171 A * 2/1998 Andres ..... 52/263
5,725,939 A 3/1998 Nishibori
5,735,092 A 4/1998 Clayton et al.
5,744,210 A 4/1998 Hofmann et al.
5,759,680 A 6/1998 Brooks et al.
5,771,646 A 6/1998 DeSouza
5,773,138 A 6/1998 Seethamraju et al.
5,776,841 A 7/1998 Bondoc et al.
5,783,125 A 7/1998 Bastone et al.
5,788,224 A 8/1998 Platt
5,795,641 A 8/1998 Pauley et al.
5,807,514 A 9/1998 Grinshpun et al.
5,827,462 A 10/1998 Brandt et al.
5,827,607 A 10/1998 Deaner et al.
5,833,358 A * 11/1998 Patik ..... 362/391
5,836,128 A 11/1998 Groh et al.
5,842,685 A 12/1998 Purvis et al.
5,847,016 A 12/1998 Cope
5,851,469 A 12/1998 Muller et al.
5,853,167 A 12/1998 West et al.
5,858,522 A 1/1999 Turk et al.
5,863,064 A 1/1999 Rheinlander et al.
5,863,480 A 1/1999 Suwanda
5,866,054 A 2/1999 Dorchester et al.

(56) References Cited

U.S. PATENT DOCUMENTS 5,866,264 A 2/1999 Zehner et al.
5,869,138 A 2/1999 Nishibori
5,869,176 A 2/1999 Dorchester et al.
5,873,671 A 2/1999 West
5,882,564 A 3/1999 Puppin
5,910,358 A 6/1999 Thoen et al.
5,932,334 A 8/1999 Deaner et al.
5,948,505 A 9/1999 Puppin
5,948,524 A 9/1999 Seethamraju et al.
5,951,927 A 9/1999 Cope
5,965,075 A 10/1999 Pauley et al.
5,981,067 A 11/1999 Seethamraju et al.
5,985,429 A 11/1999 Plummer et al.
5,988,599 A 11/1999 Forbis
6,004,652 A 12/1999 Clark
6,004,668 A 12/1999 Deaner et al.
6,007,656 A 12/1999 Heikkila et al.
6,009,682 A 1/2000 Lehman et al.
6,011,091 A 1/2000 Zehner
6,015,611 A 1/2000 Deaner et al.
6,015,612 A 1/2000 Deaner et al.
6,017,019 A 1/2000 Erwin
D419,858 S 2/2000 Bosgoed
6,029,954 A * 2/2000 Murdaca ..... 256/59
6,035,588 A 3/2000 Zehner et al.
6,041,486 A 3/2000 Forbis
6,044,604 A 4/2000 Clayton et al.
6,054,207 A 4/2000 Finley
6,061,991 A * 5/2000 Dahl ..... 52/832
6,066,367 A 5/2000 Nishibori
6,066,680 A 5/2000 Cope
6,083,601 A 7/2000 Prince et al.
6,103,791 A 8/2000 Zehner
6,106,944 A 8/2000 Heikkila et al.
6,114,008 A 9/2000 Eby et al.
6,117,924 A 9/2000 Brandt
6,122,877 A 9/2000 Hendrickson et al.
6,131,355 A 10/2000 Groh et al.
6,133,348 A 10/2000 Kolla et al.
6,153,293 A 11/2000 Dahl et al.
6,161,353 A 12/2000 Negola et al.
6,168,125 B1 1/2001 Winger et al.
6,180,211 B1 1/2001 Held
6,180,257 B1 1/2001 Brandt et al.
6,202,987 B1 3/2001 Forbis
6,207,729 B1 3/2001 Medoff et al.
6,210,616 B1 4/2001 Suwanda
6,210,792 B1 4/2001 Seethamraju et al.
6,248,813 B1 6/2001 Zehner
6,265,037 B1 7/2001 Godavarti et al.
6,272,808 B1 8/2001 Groh et al.
6,280,667 B1 8/2001 Koenig et al.
6,284,098 B1 9/2001 Jacobsen
6,295,777 B1 10/2001 Hunter et al.
6,295,778 B1 10/2001 Burt
6,305,670 B1 10/2001 Ward et al.
6,308,937 B1 10/2001 Pettit
6,336,620 B1 1/2002 Belli
6,337,138 B1 1/2002 Zehner et al.
6,341,458 B1 1/2002 Burt
6,342,172 B1 1/2002 Finley
6,344,268 B1 2/2002 Stucky et al.
6,344,504 B1 2/2002 Zehner et al.
6,346,160 B1 2/2002 Puppin
6,357,197 B1 3/2002 Serino et al.
6,358,585 B1 3/2002 Wolff
6,360,508 B1 3/2002 Pelfrey et al.
6,362,252 B1 3/2002 Prutkin
6,367,780 B1 * 4/2002 Retterer ..... 256/1
6,409,952 B1 6/2002 Hacker et al.
6,423,257 B1 7/2002 Stobart et al.
D461,568 S 8/2002 Forbis
D461,914 S 8/2002 Hughes et al.
6,427,403 B1 8/2002 Tambakis
6,448,307 B1 9/2002 Medoff et al.
6,453,630 B1 9/2002 Buhrts et al.
6,460,829 B1 10/2002 Forbis et al.
6,464,913 B1 10/2002 Korney, Jr.
6,467,756 B1 10/2002 Elsasser
6,471,192 B1 10/2002 Erwin
6,498,205 B1 12/2002 Zehner
6,511,757 B1 1/2003 Brandt et al.
D471,284 S 3/2003 Heath
6,527,469 B1 3/2003 Erwin
6,531,010 B2 3/2003 Puppin
6,543,751 B1 4/2003 Spruill
6,557,829 B1 5/2003 Steffes
6,557,831 B2 5/2003 Erwin
6,561,492 B1 5/2003 Hubbell
6,568,658 B2 5/2003 Strome
6,569,540 B1 5/2003 Preston et al.
6,575,433 B2 * 6/2003 Retterer ..... 256/1
6,578,368 B1 6/2003 Brandt et al.
6,579,605 B2 6/2003 Zehner
6,590,004 B1 7/2003 Zehner
6,601,831 B2 8/2003 Erwin
6,605,245 B1 8/2003 Dubelsten et al.
6,616,995 B2 * 9/2003 Retterer ..... 428/35.7
6,617,376 B2 9/2003 Korney, Jr.
6,619,628 B1 9/2003 Steffes
6,622,991 B2 9/2003 Steffes
6,632,863 B2 10/2003 Hutchison et al.
6,637,213 B2 10/2003 Hutchison et al.
6,641,384 B2 11/2003 Bosler et al.
6,662,515 B2 12/2003 Buhrts et al.
6,676,094 B1 1/2004 Brown
6,680,090 B2 1/2004 Godavarti et al.
6,682,056 B1 1/2004 West
6,682,789 B2 1/2004 Godavarti et al.
6,682,814 B2 1/2004 Hendrickson et al.
D487,158 S 2/2004 Forbis
6,685,858 B2 2/2004 Korney, Jr.
6,698,726 B2 3/2004 Platt
6,702,245 B1 3/2004 Otterman
6,702,259 B2 * 3/2004 Pratt ..... 256/65.03
6,708,504 B2 3/2004 Brandt et al.
6,715,242 B1 4/2004 Green et al.
6,715,725 B2 4/2004 Chipka
6,716,522 B2 4/2004 Matsumoto et al.
6,719,278 B2 4/2004 Bryan
D490,543 S 5/2004 Forbis
6,752,941 B2 6/2004 Hills
6,755,394 B2 6/2004 Forbis et al.
6,773,255 B2 8/2004 Benz et al.
6,780,359 B1 8/2004 Zehner et al.
6,784,216 B1 8/2004 Zehner et al.
6,784,230 B1 8/2004 Patterson et al.
6,793,474 B2 9/2004 Groeblacher et al.
6,805,335 B2 10/2004 Williams
6,844,049 B2 1/2005 Amin-Javaheri
6,860,472 B2 3/2005 Striebel et al.
6,863,972 B2 3/2005 Burger et al.
6,874,766 B2 * 4/2005 Curatolo ..... 256/59
D509,599 S 9/2005 MacDonald
6,939,496 B2 9/2005 Maine et al.
6,948,704 B2 9/2005 Forbis et al.
6,958,185 B1 10/2005 Zehner
6,971,211 B1 12/2005 Zehner
6,984,676 B1 1/2006 Brandt
6,986,505 B2 1/2006 Platt
7,017,352 B2 3/2006 Hutchison et al.
7,030,179 B2 4/2006 Patterson et al.
7,037,865 B1 5/2006 Kimberly
7,044,451 B2 5/2006 Platt
D536,098 S 1/2007 Walker
7,178,791 B1 2/2007 Gray et al.
7,186,457 B1 3/2007 Zehner et al.
7,378,462 B1 5/2008 Hughes et al.
7,445,840 B2 11/2008 Moriya et al.
7,543,802 B2 6/2009 Petta et al.
7,743,567 B1 6/2010 Buhrts
7,744,065 B2 * 6/2010 Terrels et al. ..... 256/59
D625,989 S 10/2010 Mancosh et al.
7,875,655 B2 1/2011 Mancosh et al.

(56) References Cited

U.S. PATENT DOCUMENTS

| | | | | |
|---|---|---|---|---|
| 7,913,960 | B1 * | 3/2011 | Herr et al. | 248/205.1 |
| 7,923,477 | B2 | 4/2011 | Murdock et al. | |
| 8,167,275 | B1 * | 5/2012 | Bizzarri et al. | 256/65.08 |
| 8,278,365 | B2 | 10/2012 | Murdock et al. | |
| 8,455,558 | B2 | 6/2013 | Mancosh et al. | |
| 8,809,406 | B2 | 8/2014 | Murdock et al. | |
| 8,905,570 | B2 * | 12/2014 | Hartman | 362/152 |
| 9,073,295 | B2 | 7/2015 | Przybylinski et al. | |
| 2001/0019749 | A1 | 9/2001 | Godavarti et al. | |
| 2001/0051242 | A1 | 12/2001 | Godavarti et al. | |
| 2001/0051243 | A1 | 12/2001 | Godavarti et al. | |
| 2002/0015820 | A1 | 2/2002 | Puppin | |
| 2002/0038684 | A1 | 4/2002 | Puppin | |
| 2002/0040557 | A1 | 4/2002 | Felton | |
| 2002/0066248 | A1 | 6/2002 | Buhrts et al. | |
| 2002/0090471 | A1 | 7/2002 | Burger et al. | |
| 2002/0092256 | A1 | 7/2002 | Hendrickson et al. | |
| 2002/0104987 | A1 | 8/2002 | Purvis | |
| 2002/0106498 | A1 | 8/2002 | Deaner et al. | |
| 2002/0113960 | A1 * | 8/2002 | Retterer | 356/246 |
| 2002/0121634 | A1 | 9/2002 | Erwin | |
| 2002/0121635 | A1 | 9/2002 | Erwin | |
| 2002/0143083 | A1 | 10/2002 | Korney, Jr. | |
| 2002/0161072 | A1 | 10/2002 | Jacoby et al. | |
| 2002/0166327 | A1 | 11/2002 | Brandt et al. | |
| 2002/0174663 | A1 | 11/2002 | Hutchison et al. | |
| 2002/0192401 | A1 | 12/2002 | Matsumoto et al. | |
| 2002/0192431 | A1 | 12/2002 | Edgman | |
| 2003/0006405 | A1 | 1/2003 | Striebel et al. | |
| 2003/0021915 | A1 | 1/2003 | Rohatgi et al. | |
| 2003/0025233 | A1 | 2/2003 | Korney, Jr. | |
| 2003/0050378 | A1 | 3/2003 | Blanchard et al. | |
| 2003/0085395 | A1 | 5/2003 | Gardner | |
| 2003/0087994 | A1 | 5/2003 | Frechette | |
| 2003/0087996 | A1 | 5/2003 | Hutchison et al. | |
| 2003/0089056 | A1 * | 5/2003 | Retterer | 52/223.8 |
| 2003/0096094 | A1 | 5/2003 | Hayduke | |
| 2003/0136954 | A1 | 7/2003 | Platt | |
| 2003/0136955 | A1 | 7/2003 | Platt | |
| 2003/0154662 | A1 | 8/2003 | Bruchu et al. | |
| 2003/0176538 | A1 | 9/2003 | Wu et al. | |
| 2003/0196395 | A1 | 10/2003 | Forbis et al. | |
| 2003/0222258 | A1 | 12/2003 | Forbis et al. | |
| 2003/0229160 | A1 | 12/2003 | Williams et al. | |
| 2003/0234391 | A1 | 12/2003 | Sheppard et al. | |
| 2004/0003568 | A1 | 1/2004 | McCarthy | |
| 2004/0026021 | A1 | 2/2004 | Groh et al. | |
| 2004/0026679 | A1 | 2/2004 | Terrels et al. | |
| 2004/0026680 | A1 | 2/2004 | Williams | |
| 2004/0038002 | A1 | 2/2004 | Franco et al. | |
| 2004/0048055 | A1 | 3/2004 | Branca | |
| 2004/0051092 | A1 | 3/2004 | Curatolo | |
| 2004/0071964 | A1 | 4/2004 | Nesbitt | |
| 2004/0099855 | A1 | 5/2004 | Platt | |
| 2004/0142157 | A1 | 7/2004 | Melkonian | |
| 2004/0147625 | A1 | 7/2004 | Dostal et al. | |
| 2004/0148965 | A1 | 8/2004 | Hutchison et al. | |
| 2004/0188666 | A1 | 9/2004 | Pratt | |
| 2004/0191494 | A1 | 9/2004 | Nesbitt | |
| 2004/0192794 | A1 | 9/2004 | Patterson et al. | |
| 2004/0206028 | A1 * | 10/2004 | Terrels | E04H 17/1443 52/287.1 |
| 2004/0219357 | A1 | 11/2004 | Van Dijk et al. | |
| 2004/0220299 | A1 | 11/2004 | Drabeck, Jr. et al. | |
| 2005/0009960 | A1 | 1/2005 | Ton-That et al. | |
| 2005/0013984 | A1 | 1/2005 | Dijk et al. | |
| 2005/0051761 | A1 | 3/2005 | Caissie et al. | |
| 2005/0067729 | A1 | 3/2005 | Laver et al. | |
| 2005/0127346 | A1 | 6/2005 | Steffes | |
| 2005/0133777 | A1 | 6/2005 | Forbis et al. | |
| 2005/0154094 | A1 | 7/2005 | Maeda et al. | |
| 2005/0163969 | A1 | 7/2005 | Brown | |
| 2005/0171246 | A1 | 8/2005 | Maine et al. | |
| 2005/0192382 | A1 | 9/2005 | Maine et al. | |
| 2005/0218279 | A1 | 10/2005 | Cicenas et al. | |
| 2005/0258413 | A1 | 11/2005 | Platt | |
| 2005/0266222 | A1 | 12/2005 | Clark et al. | |
| 2005/0271872 | A1 | 12/2005 | Dolinar | |
| 2005/0271889 | A1 | 12/2005 | Dolinar | |
| 2005/0274940 | A1 | 12/2005 | Brown | |
| 2006/0010883 | A1 | 1/2006 | Hutchison et al. | |
| 2006/0010884 | A1 | 1/2006 | Hutchison et al. | |
| 2006/0012066 | A1 | 1/2006 | Hutchison et al. | |
| 2006/0012071 | A1 | 1/2006 | Groh et al. | |
| 2006/0022187 | A1 | 2/2006 | Forbis et al. | |
| 2006/0022372 | A1 | 2/2006 | Matuana et al. | |
| 2006/0057348 | A1 | 3/2006 | Maine et al. | |
| 2006/0068053 | A1 | 3/2006 | Brandt et al. | |
| 2006/0068215 | A2 | 3/2006 | Dolinar | |
| 2006/0076545 | A1 * | 4/2006 | Reynders et al. | 256/59 |
| 2006/0113441 | A2 | 6/2006 | Cicenas et al. | |
| 2006/0147693 | A1 | 7/2006 | Przybylinski et al. | |
| 2006/0269738 | A1 | 11/2006 | Kimberly | |
| 2007/0173551 | A1 | 7/2007 | Mancosh et al. | |
| 2007/0235705 | A1 | 10/2007 | Burger et al. | |
| 2007/0296112 | A1 | 12/2007 | Brandt et al. | |
| 2008/0064794 | A1 | 3/2008 | Murdock et al. | |
| 2008/0093763 | A1 | 4/2008 | Mancosh et al. | |
| 2008/0128933 | A1 | 6/2008 | Przybylinski et al. | |
| 2008/0197523 | A1 | 8/2008 | Heigel et al. | |
| 2008/0213562 | A1 | 9/2008 | Przybylinski et al. | |
| 2009/0264560 | A1 | 10/2009 | Warnes et al. | |
| 2010/0159213 | A1 | 6/2010 | Przybylinski et al. | |
| 2011/0073824 | A1 | 3/2011 | Lappin et al. | |
| 2011/0097552 | A1 | 4/2011 | Mancosh et al. | |
| 2011/0229691 | A1 | 9/2011 | Murdock et al. | |
| 2012/0077890 | A1 | 3/2012 | Mancosh et al. | |
| 2012/0217460 | A1 * | 8/2012 | Bugh | 256/73 |
| 2012/0236547 | A1 * | 9/2012 | Hartman | 362/152 |
| 2012/0315471 | A1 | 12/2012 | Mancosh et al. | |
| 2013/0102707 | A1 | 4/2013 | Murdock et al. | |
| 2015/0024171 | A1 | 1/2015 | Murdock et al. | |
| 2015/0044434 | A1 | 2/2015 | Kotiadis et al. | |

FOREIGN PATENT DOCUMENTS

| | | | |
|---|---|---|---|
| CA | D80640 | | 5/1997 |
| CH | 580130 | A5 | 9/1976 |
| CL | 34395 | | 3/1995 |
| CL | 303799 | | 12/1999 |
| DE | 2042176 | | 4/1971 |
| DE | 3801574 | A1 | 8/1989 |
| DE | 4033849 | A1 | 4/1991 |
| DE | 4221070 | A1 | 12/1993 |
| DK | 140148 | B | 6/1979 |
| EP | 0269470 | A2 | 6/1988 |
| EP | 0586211 | A1 | 3/1994 |
| EP | 0586212 | A2 | 3/1994 |
| EP | 0586213 | A1 | 3/1994 |
| EP | 0668142 | A1 | 8/1995 |
| EP | 0747419 | A2 | 12/1996 |
| EP | 0874944 | A1 | 11/1998 |
| ES | 1041676 | | 11/1998 |
| FR | 2270311 | A1 | 12/1975 |
| FR | 2365017 | A1 | 4/1978 |
| FR | 2445885 | A1 | 8/1980 |
| FR | 2529925 | A1 | 1/1984 |
| FR | 2564374 | A1 | 11/1985 |
| GB | 567071 | | 1/1945 |
| GB | 1298823 | | 12/1972 |
| GB | 1443194 | | 7/1976 |
| GB | 2036148 | A | 6/1980 |
| GB | 2104903 | A | 3/1983 |
| GB | 2171953 | A | 9/1986 |
| GB | 2186655 | A | 8/1987 |
| JP | 57-190035 | A | 11/1982 |
| JP | 2000-17245 | A | 1/2000 |
| JP | 2000-109589 | A | 4/2000 |
| JP | 2002-86544 | A | 3/2002 |
| JP | 2002-113768 | A | 4/2002 |
| JP | 2002-137333 | A | 5/2002 |
| JP | 2002-144489 | A | 5/2002 |
| KR | 20040044680 | A | 5/2004 |
| WO | 90/08020 | A1 | 7/1990 |

(56) References Cited

FOREIGN PATENT DOCUMENTS

| | | | |
|---|---|---|---|
| WO | 95/13179 | A1 | 5/1995 |
| WO | 97/26430 | A1 | 7/1997 |
| WO | 99/11444 | A1 | 3/1999 |
| WO | 00/11282 | A2 | 3/2000 |
| WO | 00/34017 | A1 | 6/2000 |
| WO | 00/39207 | A1 | 7/2000 |
| WO | 01/66873 | A1 | 9/2001 |
| WO | 02/057692 | A2 | 7/2002 |
| WO | 02/079317 | A1 | 10/2002 |
| WO | 02/103113 | A2 | 12/2002 |
| WO | D064769-006 | | 10/2003 |
| WO | 03/091642 | A1 | 11/2003 |
| WO | 2004/083541 | A2 | 9/2004 |
| WO | 2004/083541 | A3 | 11/2004 |
| WO | 2004/102092 | A1 | 11/2004 |
| WO | 2006/041508 | A2 | 4/2006 |
| WO | 2006/071517 | A2 | 7/2006 |
| WO | 2007/085836 | A1 | 8/2007 |

OTHER PUBLICATIONS

Reineke, Wood Flour, U.S. Department of Agriculture Forest Service, U.S. Forest Service Research Note FPL-0113, Jan. 1966, 7 pages.
Resin Stretching: Accent on Performance, Modern Plastic International, Jan. 1974, pp. 58-60.
Robson et al., A Comparison of Wood and Plant Fiber Properties, Proceedings: Woodfiber-Plastic Composites, 1995, pp. 41-46.
Rogalski et al., Poly(Vinyl-Chloride) Wood Fiber Composites, ANTEC, 1987, pp. 1436-1441.
Royal Group Technologies, Inc., New Composite Building Material Adds the Right Mix of Beauty and Brawn to Upscale Homes, www.royalgrouptech.com, printed Aug. 18, 2005, 3 pages.
Schneider et al., Biofibers as Reinforcing Fillers in Thermoplastic Composites, ANTEC, 1994, pp. 6 pages.
Schut, Compatibilizing Mixed Post-Consumer Plastics, Plastics Formulating & Compounding, Mar./Apr. 1997, pp. 43.
Simonsen et al., Wood-Fiber Reinforcement of Styrene-Maleic Anhydride Copolymers, J. Appl. Polm. Sci. 68, No. 10, Jun. 6, 1998, pp. 1567-1573.
Sonwood Outline, Sonesson Plast AB, Apr. 1975.
Sonwood: a new PVC wood-flour alloy for Extrusions and other Plastic Processing Techniques, Sonesson Plast AB, Malmo, Sweden (1975).
Fiberon, Installation instructions, Fiber Composites, LLC, Apr. 2006, 13 pages.
Webpages, www.americanwaymfg.com, printed Jun. 12, 2006, 2 pages.
Webpages, www.composatron.com, printed Jun. 12, 2006, 5 pages.
Webpages, www.stallionfence.com, printed Jun. 2, 2006, 2 pages.
Webpages, www.certainteed.com, printed Feb. 23, 2005, 55 pages.
Webpages, www.fibercomposites.com, printed Feb. 23, 2005, 21 pages.
Webpages, www.kroybp.com, printed Feb. 23, 2005, 4 pages.
Webpages, www.monarchdeck.com, printed Feb. 23, 2005, 24 pages.
Webpages, www.premierrailing.com, printed Feb. 23, 2005, 9 pages.
Webpages, www.trex.com, printed Feb. 23, 2005, 25 pages.
Webpages, www.weatherbest.Ipcorp.com, printed Feb. 23, 2005, 10 pages.
Timbertech, TimberTech Deck/Railing Installation Instructions and Warranty, Dec. 2003, 8 pages, TimberTech, Wilmington, Ohio.
Timbertech, TimberTech Deck and Railing Installation Instructions and Warranty, Jan. 2005, 12 pages, TimberTech, Wilmington, Ohio.
Timbertech, TimberTech Deck and Railing Installation Instructions and Warranty, Oct. 2005, 16 pages, TimberTech, Wilmington, Ohio.
Timbertech, Your Ultimate Escape, 2005, 2 pages, TimberTech, Wilmington, Ohio.
Timbertech, Product Choices, 2005, 2 pages, TimberTech, Wilmington, Ohio.
Timbertech, Product Catalog, 2006, 20 pages, TimberTech, Wilmington, Ohio.
Internet Archive Wayback Machine search results for htto://www.fencescape.com [online] showing results spanning from Jul. 20, 2001 to Oct. 9, 2007 [retrieved Mar. 10, 2011]. Retrieved from the internet<URL: http://web.archive.org/web*/www.fencescape.com>.
Stark et al., Effect of Particle Size on Properties of Wood-Flour Reinforced Polypropylene Composites, The Fourth International Conference on Woodfiber-Plastic Composites, 1997, pp. 134-143.
Stark et al., Photostabilization of Wood Flour Filled HDPE Composites, ANTEC, May 5-9, 2002, pp. 2209-2013.
Stark, Wood Fiber Derived From Scrap Pallets Used in Polypropylene Composites, Forest Products Journal, vol. 49, No. 6, Jun. 1999, pp. 39-46.
Suchsland et al., Fiberboard Manufacturing Practices in the United States, Agriculture Handbook No. 640, United States Department of Agriculture Forest Service, 1986, 4 pages.
Thomas et al., Wood Fibers for Reinforcing Fillers for Polyolefins, ANTEC, 1984, pp. 687-689.
Wood Filled PVC, Plastics Industry News, Jul. 1996, p. 6.
Woodhams et al., Wood Fibers for Reinforcing Fillers for Polyolefins, Polymer Engineering and Science, Oct. 1984, pp. 1166-1171.
Yam et al., Composites from Compounding Wood Fibers With Recycled High Density Polyethylene, Polymer Engineering and Science, mid-Jun. 1990, pp. 693-699, vol. 30, No. 11.
Yuskova et al., Interaction of Components in Poly(Vinyl Chloride) Filled in Polymerization, Makroniol Chem., Macromol. Symp. 29, 315-320 (1989).
Zadorecki et al., Future Prospects for Wood Cellulose as Reinforcement in Organic Polymer Composites, Polymer Composites, Apr. 1989, pp. 69-77.
ASTM, Standard Terminology Relating to Wood-Base Fiber and Particle Panel Material, 1995 Annual Book of ASTM Standards, vol. 04.10, Oct. 1986, pp. 214-216.
Bendtsen et al., Chapter 4: Mechanical Properties of Wood, USDA Ag. Hdbk. #72, Wood Handbook: Wood as an Engineering Material, Madison, WI, pp. 4-2 to 4-44 (1987).
Bibliography of Solid Phase Extrusion, pp. 187-195.
Brzoskowski et al., Air-Lubricated Die for Extrusion of Rubber Compounds, Rubber Chemistry and Technology, vol. 60, p. 945-956 (1987).
Campbell et al., The Reinforcement of Thermoplastic Elastomers With Santoweb® Fibre, Short Fibre Reinforced Thermoplastics, pp. 14/1-14/10.
Collier et al., High Strength Extrudates by Melt Transformation Coextrusion, ANTEC, 1987, pp. 497-502.
Collier et al., Streamlined Dies and Profile Extrusion, ANTEC, 1987, pp. 203-206.
Company News, Plastics Industry News, May 1994, pp. 70-71.
Dalvag et al., The Efficiency of Cellulosic Fillers in Common Thermoplastics. Part II. Filling with Processing Aids and Coupling Agents, 1985, vol. 11, pp. 9-38.
Doroudiani et al., Structure and Mechanical Properties Study of Foamed Wood Fiber/Polyethylene Composites, ANTEC, 1997, pp. 2046-2050.
Ein Engineering Inc., Making Wood From Waste Wood and Waste Plastic Using Ein Technology, Ein Plastic & Wood Recycling System Catalog, 1999, 16 pages.
Ein Engineering Inc., Wood-like Material Superior to Real Wood, 5 pages.
English et al., Wastewood-Derived Fillers for Plastics, The Fourth International Conference on Woodfiber-Plastic Composites, 1997, pp. 309-324.
Fiberloc Polymer Composites, B.F. Goodrich, Geon Vinyl Division, section 1, pp. 2-15 (1986).
Fill Thermoplastics with Wood, Modern Plastics, May 1974, pp. 54-55.
Fillers for Thermoplastics: Beyond Resin Stretching, Modern Plastics International, Oct. 1976, pp. 12-15.

(56) References Cited

OTHER PUBLICATIONS

From Sweden: Extruded Interior Trim Made of PVC and Wood Fluor, Plastic Building Construction, vol. 9 No. 5, 1986, pp. 5-6.
Forest Products Laboratory, Wood Handbook: Wood as an Engineering Material, Agriculture Handbook 72, United States Department of Agriculture Forest Service, 1974, 2 pages.
Gatenholm et al., The Effect of Chemical Composition of Interphase on Dispersion of Cellulose Fibers in Polymers. I. PVC-Coated Cellulose in Polystyrene, Journal of Applied Polymer Science, vol. 49, 1993, pp. 197-208.
Henrici-Olive et al., Integral/Structural Polymer Foams: Technology, Properties and Applications, Springer Verlag, pp. 111-122 (1986).
Klason et al., The Efficiency of Cellulosic Fillers in Common Thermoplastics. Part 1. Filling without Processing Aids or Coupling Agents, Polymeric Materials, 1984, vol. 10, pp. 159-187.
Kokta et al., Composites of Poly(Vinyl Chloride) and Wood Fibers. Part II: Effect of Chemical Treatment, Polymer Composites, Apr. 1990, pp. 84-89.
Kokta et al., Composites of Polyvinyl Chloride—Wood Fibers. I. Effect of Isocyanate as a Bonding Agent, Polym.-Plast. Technol. Eng., 1990, 29(1&2), pp. 87-118.
Kokta et al., Composites of Polyvinyl Chloride—Wood Fibers. III: Effect of Silane as Coupling Agent, Journal of Vinyl Technology, Sep. 1990, pp. 146-153.
Kokta et al., "Use of Grafted Wood Fibers in Thermoplastic Composites v. Polystyrene", Centre de recherche en pâtes et papiers, Université du Québec á Trois-Rivières, Canada (1986).
Kokta et al., Use of Wood Fibers in Thermoplastic Composites, Polymer Composites, Oct. 1983, pp. 229-232.
Kowalska et al., Modification of Recyclates of Polyethylene and Poly(Vinyl Chloride) with Scrap Paper Cellulose Fibres, Polymer Recycling, vol. 16, Nos. 2/3, 2001, pp. 109-118.
Lightsey, Organic Fillers for Thermoplastics, Polymer Science and Technology, vol. 17, Aug. 1981, pp. 193-211.
Maldas et al., Composites of Polyvinyl Chloride—Wood Fibers: IV. Effect of the Nature of Fibers, Journal of Vinyl Technology, Jun. 1989, pp. 90-98.
Maldas et al., Improving Adhesion of Wood Fiber with Polystyrene by the Chemical Treatment of Fiber with a Coupling Agent and the Influence of the Mechanical Properties of Composites, Journal of Adhesion Science Techology, vol. 3 No. 7, pp. 529-539 (1989).
Maloney, Modern Particleboard & Dry-Process Fiberboard Manufacturing, Miller Freeman Publications, 1977, 6 pages.
Myers et al., "Wood flour and polypropylene or high-density polyethylene composites: influence of maleated polypropylene concentration and extrusion temperature on properties", Forest Products Society, Wood Fiber/Polymer Composites: Fundamental Concepts, Processes, and Material Options, Madison, WI, pp. 49-56 (1993).
Myers et al., Bibliography: Composites from Plastics and Wood-Based Fillers, USDA Forest Products Laboratory, Madison, WI, pp. 1-27 odds (1991).
Myers et al., Effects of Composition and Polypropylene Melt Flow on Polypropylene—Waste Newspaper Composites, ANTEC, 1992, pp. 602-604.
Panshin et al., Forest Products, Wood Flour, Chapter 11, 1950, pp. 232-239.
Pornnimit et al., Extrusion of Self-Reinforced Polyethylene, Advances in Polymer Technology, vol. 11, No. 2, pp. 92-98 (1992).
Raj et al., The Influence of Coupling Agents on Mechanical Properties of Composites Containing Cellulose Fillers, Marcel Dekker, Inc., 1990, pp. 339-353.
Raj et al., Use of Wood Fiber as Filler in Common Thermoplastics: Studies on Mechanical Properties, Science and Engineering of Composite Materials, vol. 1 No. 3, 1989, pp. 85-98.
Raj et al., Use of Wood Fibers in Thermoplastics. VII. The Effect of Coupling Agents in Polyethylene—Wood Fiber Composites, Journal of Applied Polymer Science, vol. 37, pp. 1089-1103 (1989).
Advanced Environmental Recycling Technologies, Inc., Composite Railing Installation, www.moistureshield.com, Jul. 2015.
Advanced Environmental Recycling Technologies, Inc., Magnum Railing, www.lifecycledecking.com/products/profiles , Oct. 17, 2010, visited Jan. 29, 2016 via https://web.archive.org/web/20101017132410/http://lifecycledecking.com/products/profiles.
CertainTeed Corporation, www.certainteed.com/products/fence-railing-deck/railing/313628 Mar. 7, 2009, visited Jan. 29, 2016 via https://web.archive.org/web/20090307163124/http://www.certainteed.com/products/fence-railing-deck/railing/313628.
CertainTeed Corporation, Step-By-Step Installation Instructions for Panorama Composite Railing System Square or Steel Balusters, Aug. 2014.
CertainTeed Corporation, PANORAMA, Registration No. 3,326,317, registered Oct. 30, 2007.
CertainTeed Corporation, Panorama Composite Railing System, www.certainteed.com/products/fence-railing-deck/railing/313628, visited Jan. 29, 2016.
Alleged pictures of Trex Transcend Top Rail, Green Bay Decking—Integra Rail, RDI Transform Series Rail, Gossen Railing, and Menards Ultradeck Railing, received on or about Dec. 4, 2015, from third party (titles and miscellaneous text have been added by third party; original sources/authors, titles, and publication dates of pictures not known).
Alleged pictures of Fiberon/Fiber Composites, LLC Railing allegedly circa 2002, Gossen Railing, AERT Railing, and Certainteed Panorama Railing, received on or about Dec. 4, 2015, from third party (titles and miscellaneous text/symbols have been added by third party; original sources/authors, titles, and publication dates of pictures not known).
Gossen Corporation, Performance Railing System, http://www.gossencorp.com/railing.php, Jun. 11, 2014, visited Jan. 29, 2016 via https://web.archive.org/web/20140611083437/http://www.gossencorp.com/railing.php.
Gossen Corporation, Code Compliance Research Report CCRR-0221, Apr. 7, 2015.
Gossen Corporation, Gossen WeatherReady Railing, http://www.gossencorp.com/railing.php, Sep. 3, 2012, visited Jan. 29, 2016 via https://web.archive.org/web/20120903150713/http://www.gossencorp.com/railing.php.
Green Bay Decking LLC, Integra Rail, U.S. Appl. No. 77/852,500, filed Oct. 20, 2009.
The Des Moines Register, p. 405, Jun. 29, 2003.
Midwest Manufacturing, Natural Railing, http://www.midwestmanufacturing.com/MidwestManufacturing/productDetail.do?groupId=1&lineId=8&productTypeId=4&productId=201 , Sep. 22, 2014, visited Jan. 26, 2016 via https://web.archive.org/web/20140922121245/http://www.midwestmanufacturing.com/MidwestManufacturing/productDetail.do?groupId=1&lineId=8&productTypeId=4&productId=201.
Midwest Manufacturing, Pinnacle Top Rail Caps, http://www.midwestmanufacturing.com/MidwestManufacturing/productDetail.do?groupId=1&lineId=8&productTypeId=4&productId=1366, Aug. 3, 2010, visited Jan. 28, 2016 via https://web.archive.org/web/20100803030153/http://www.midwestmanufacturing.com/MidwestManufacturing/productDetail.do?groupId=1&lineId=8&productTypeId=4&productId=1366.
UltraDeck Reversible, http://ultradeck.com/products.htm, Feb. 13, 2005, visited Jan. 28, 2016 via https://web.archive.org/web/20050213125854/http://ultradeck.com/products.htm.
Midwest Manufacturing, UltraDeck Rustic Rail, http://www.midwestmanufacturing.com/MidwestManufacturing/productDetail.do?groupId=1&lineId=8&productTypeId=4&productId=200 , May 22, 2013, visited Jan. 26, 2016 via https://web.archive.org/web/20130522185339/http://www.midwestmanufacturing.com/MidwestManufacturing/productDetail.do?groupId=1&lineId=8&productTypeId=4&productId=200.
Menard, Inc., ULTRADECK, U.S. Pat. No. 2,933,451, registered Mar. 15, 2005.
Railing Dynamics, Inc., TRANSFORM, Registration No. 4,569,628, registered Jul. 15, 2014 and TRANSFORM (& Design), U.S. Pat. No. 4,569,629, registered Jul. 15, 2014.

(56) References Cited

OTHER PUBLICATIONS

Trex Company, Inc. Trex Artisan Series Railing, U.S. Pat. No. 3,182,562, registered Dec. 12, 2006.
Google Images, Trex Transcend Railing, example at https://www.google.com/search?q=trex+transcend+railing&rlz=1C2OPRB_enUS555US555&biw=1424&bih=951&tbm=isch&tbo=u&source=univ&sa=X&sqi=2&ved=0ahUKEwjbqK-EztfKAhUHuIMKHYSyAnQQsAQIPg#imgrc=_, example visited Jan. 26, 2016.
Trex Company, Inc., Trex Transcend, U.S. Pat. No. 4,107,731, registered Mar. 6, 2012.
Trex Company, Inc., Transcend, U.S. Pat. No. 3,773,349, registered Apr. 6, 2010.
Trex Company, Inc., Transcend, www.trex.com/products/railing/transcend/, visited Jan. 26, 2016.

* cited by examiner

RAIL SYSTEM AND METHOD FOR ASSEMBLY

This application is a continuation of U.S. application Ser. No. 13/461,496, filed May 1, 2012, which is a continuation of U.S. application Ser. No. 12/831,064, filed Jul. 6, 2010, now U.S. Pat. No. 8,167,275, which is a continuation of U.S. patent application Ser. No. 11/292,269, filed Nov. 30, 2005, each of which is hereby incorporated by reference in its entirety.

TECHNICAL FIELD

The present invention relates generally to railing components and systems and related methods for assembly.

BACKGROUND AND SUMMARY OF THE INVENTION

Railing systems have been used in various forms to protect and secure people, animals, and land. Railing systems have also been used to prevent entry into a designated area. While these functional railing uses continue today, railing systems may also be used for decorative purposes such as on porches and decks and around yards and gardens.

Known railing systems suffer from various drawbacks. For instance, many conventional railing systems are difficult to install, thereby requiring significant amounts of on-site labor. In addition, many railing systems require an excessive number of parts in order to complete an installation. For example, known systems may require different components for perpendicular and angled installations (e.g., relative to a support post). In other words, these systems may require different components for perpendicular installations as compared to the components used for angled installations. In fact, these systems may also require different components for angled installations in which the railing is horizontal as compared to angled installations in which the railing is at a vertical angle relative to a support post (e.g., a stair rail installation). As might be expected, the extra components may increase the complexity and cost of the manufacturing, shipping, and installation of the railing assembly. On the other hand, some existing railing assemblies may not even allow angled installations. Moreover, known railing systems may also fail to provide a desired aesthetic appearance. For example, these railing systems may leave the support hardware exposed, which limits the visual appearance of the product. In light of shortcomings such as these, there is a need for an improved rail system and method of assembly.

The present invention provides a rail system that may be comprised of any material that is suitable for the intended purpose of the railing. For example, the rail system may be comprised of a composite material that is durable and resistant to weathering. In addition, an exemplary embodiment of the rail system may be easily assembled on-site. If desired, the rail system may be at least partially pre-assembled at an off-site location. In one exemplary embodiment, the rail system may be uniquely designed to accommodate perpendicular and angled installations (e.g., both in the horizontal and vertical planes). In another exemplary embodiment, the rail system may be easily assembled such that the support hardware is substantially hidden from view after installation, thereby enhancing the appearance of the railing. In light of such benefits, the present invention may provide an easy to install, weather-resistant, safe, secure, and aesthetically pleasing rail system that is suitable for a variety of indoor and outdoor uses.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
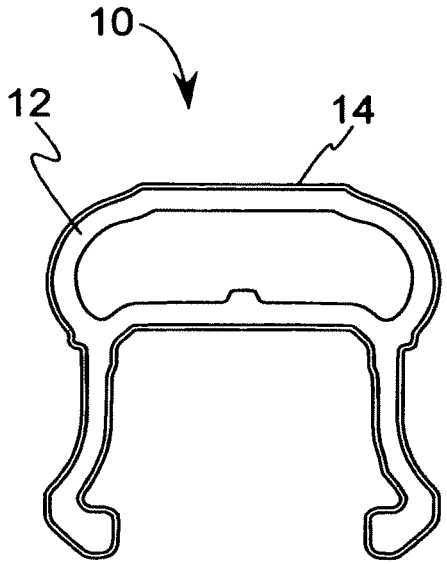
FIG. 1 is a cross-sectional view of an exemplary embodiment of a rail of the present invention.

FIG. 1 illustrates an example of a component of the present invention. In this example, handrail 10 is comprised of a composite substrate 12 and a capstock layer 14. The handrail 10 may, for example, be useful for a deck railing system or other similar or suitable types of railing.

Figure 2:
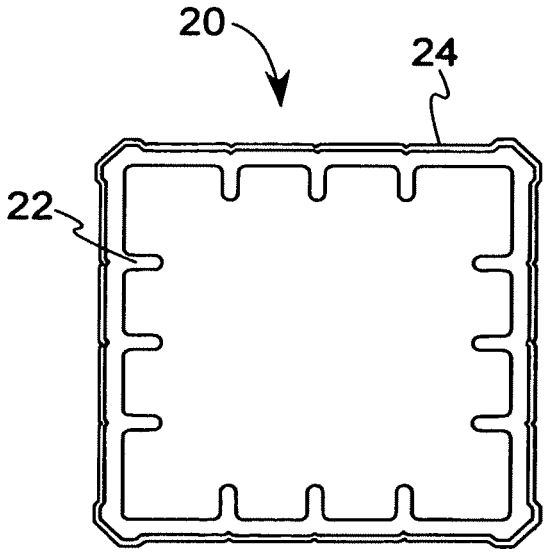
FIG. 2 is a cross-sectional view of an exemplary embodiment of a post cover of the present invention.

Another exemplary component of the present invention is illustrated in FIG. 2. FIG. 2 shows an exemplary rail post cover 20 that also comprises a composite substrate 22 and a capstock layer 24. Such a cover may be installed, for example, over an existing wood post to provide an aesthetically pleasing appearance as well as to provide protection from exposure to the elements.

FIG. 3A through 22D show an example of a railing system that may utilize the components shown in FIGS. 1 and 2. The novel features of this exemplary embodiment provide an easy method of assembling the rail components to accommodate linear and angled walkways as well as stair rail applications that require changes in elevation.

In particular, rail 10 and rail 50 may be connected to post cover 20 at a variety of horizontal and vertical angles, such as for deck and stair applications. Optional post covers 20, post caps 26, and post skirts 28 may be installed over pre-installed posts from which they derive structural rigidity and strength. Nevertheless, it should be recognized that the railing may utilize a post without the benefit of the post cover components.

Figure 3A:
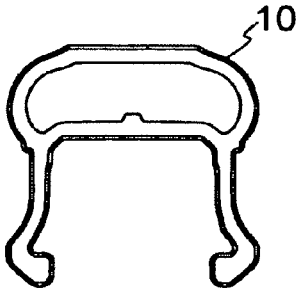
FIGS. 3A through 3K illustrate the components of an exemplary embodiment of a rail system that may utilize the present invention.
Figure 3B:
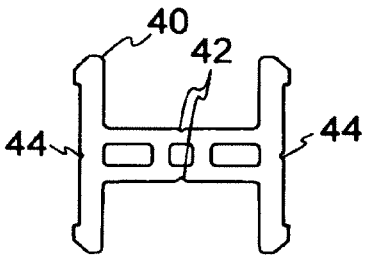
Figure 3C:
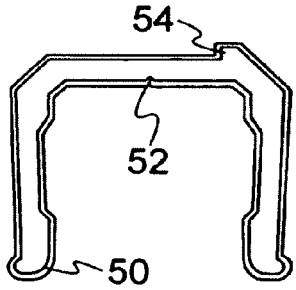
Figure 3D:
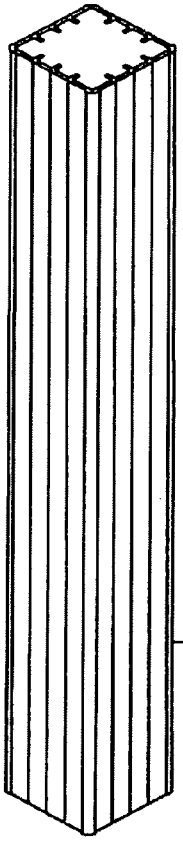
Figure 3E:
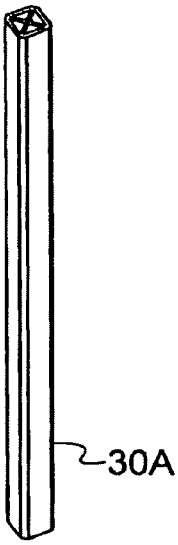
Figure 3F:
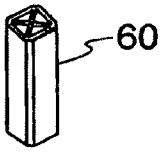
Figure 3G:
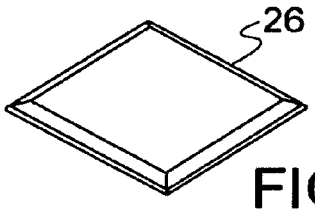
Figure 3H:
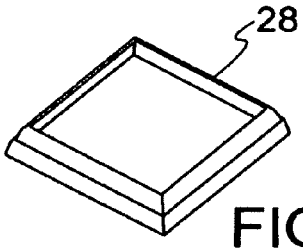
Figure 3I:
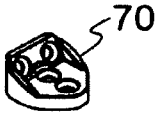
Figure 3J:
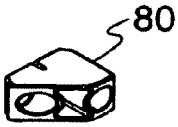

In the railing system, balusters 30A or 30B extend between an upper support rail 40 and bottom rail 50. FIG. 3E shows an example of a baluster 30A, which has inner webbing and a screw boss. However, as shown in subsequent figures, the present invention also includes baluster configurations that do not have inner webbing.

Top rail 10 and bottom rail 50 are fitted over respective support rails 40. At least one squash block 60 may be installed beneath the lower support rail 40 where desired to provide additional rigidity and support against sagging (e.g., for long spans of railing that extend between post covers 20). A squash block 60 may have a design similar to a baluster, and it may have similar means of connection to a support rail 40 as a baluster.

Figure 3K:
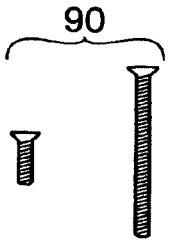

Brackets 70 and support blocks 80 provide a means for attaching the support rails 40 to the post covers 20. Optionally, fasteners 90 may be used to secure brackets 70 and support blocks 80 to post covers 20 and support rails 40. It should be noted that FIG. 3K shows various sizes of fasteners, which are collectively identified as fasteners 90. An appropriate size of fastener 90 may be selected for each intended use. Examples of fasteners 90 include, but are not limited to, screws, nails, and other similar or suitable mechanical fastening devices. In some embodiments of the railing, other means (e.g., adhesives or a suitable interference fit) may be used alone or in combination with fasteners 90 to secure brackets 70 and support blocks 80.

Figure 4:
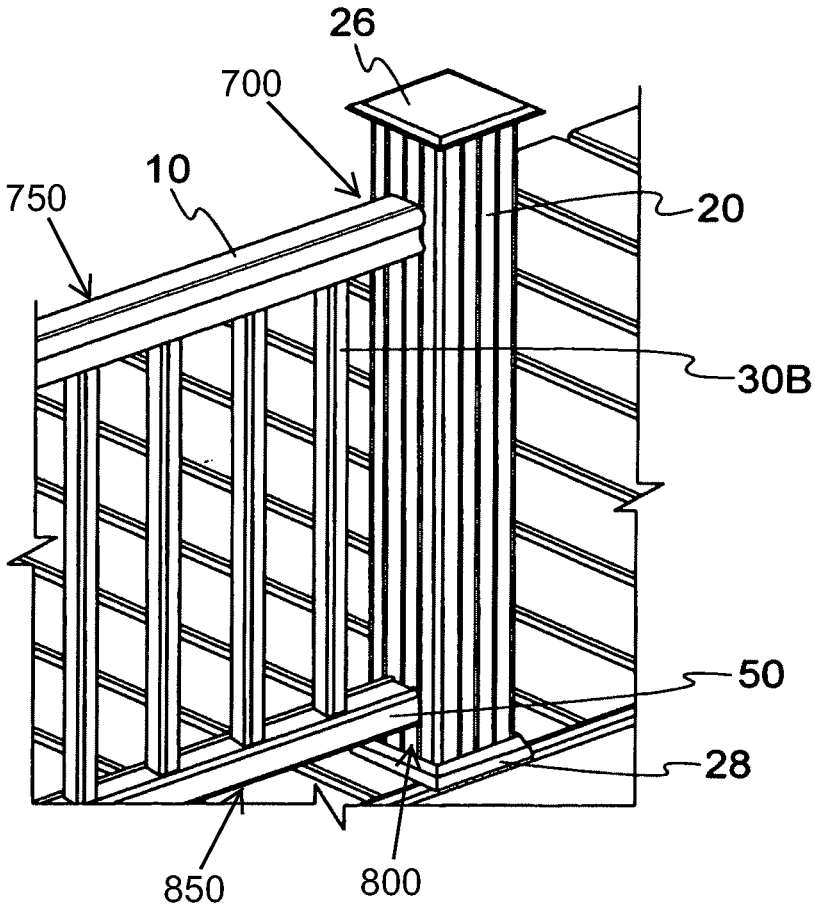
FIG. 4 is a partial perspective view of an exemplary embodiment of a rail system using at least some of the components of FIGS. 3A through 3K.

FIG. 4 illustrates an exemplary handrail installation showing the relative positions of top rail 10, post cover 20, post cap 26, post skirt 28, bottom rail 50, and interconnecting balusters 30B. It should be noted that in this exemplary embodiment, any or all of the components may be fabricated as described above to provide a durable, weather-resistant, and aesthetically pleasing railing system.

Figure 5:
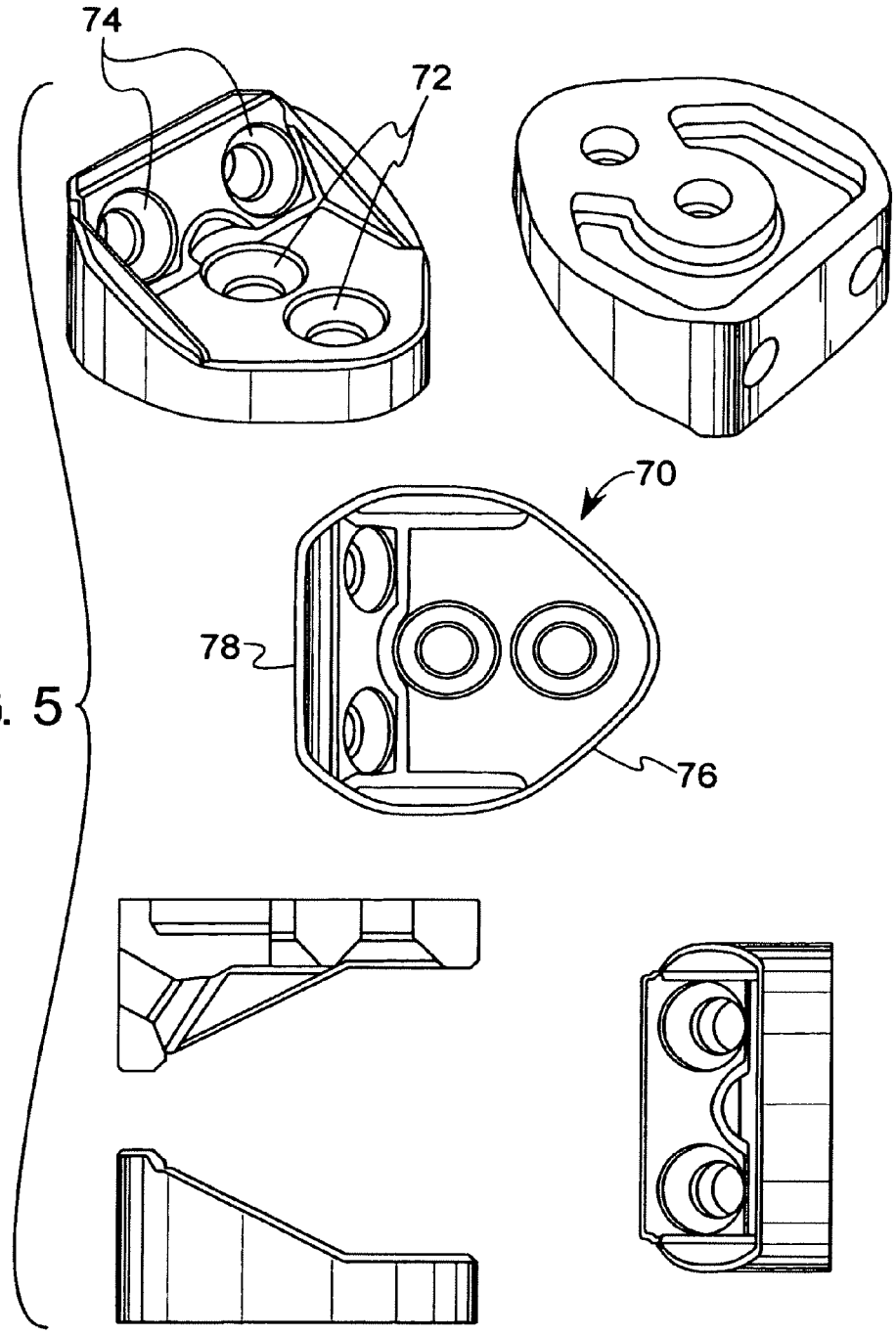
FIG. 5 illustrates various views of the exemplary embodiment of the bracket of FIG. 3I.
Figure 6:
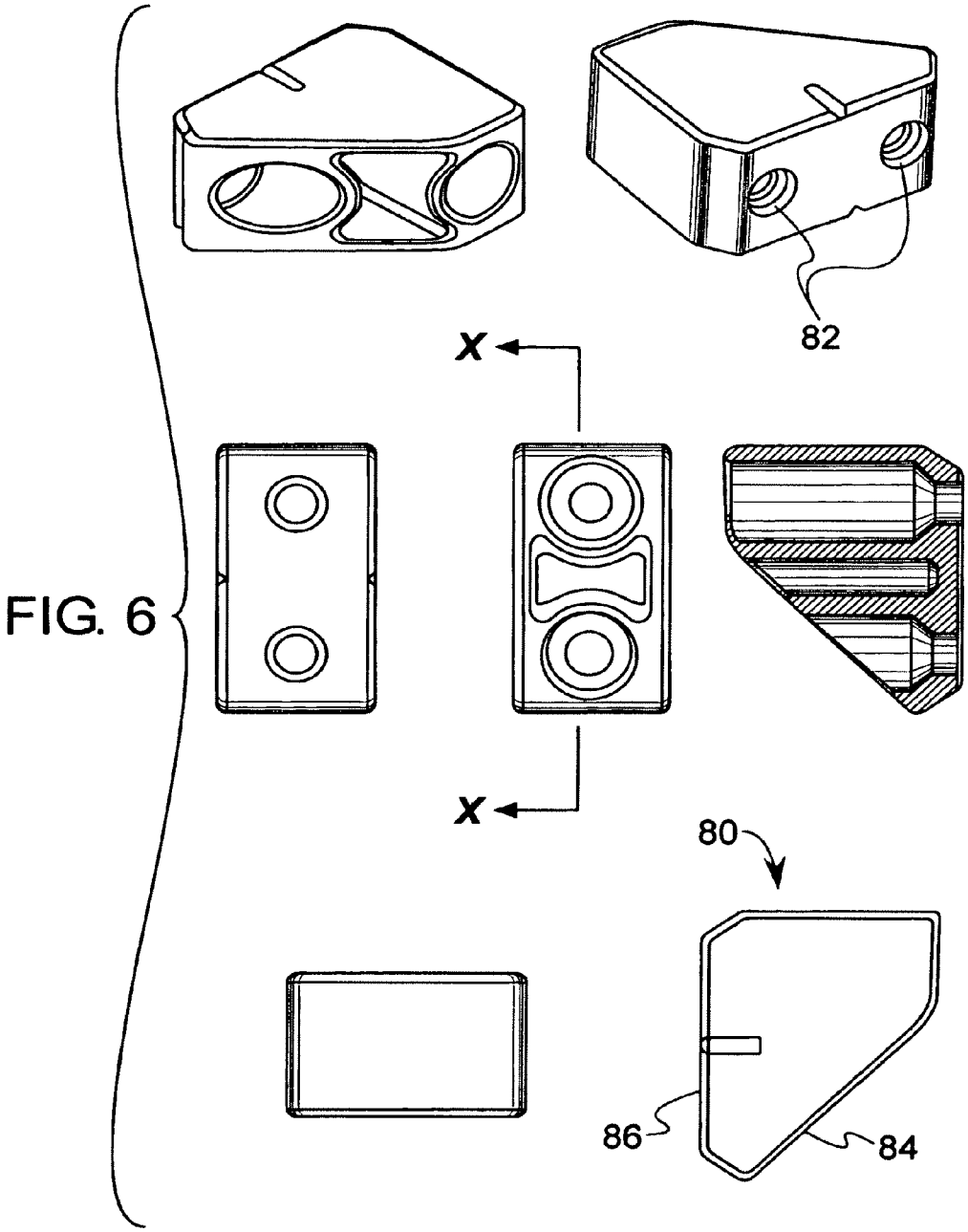
FIG. 6 illustrates various views of the exemplary embodiment of the support block of FIG. 3J.

FIGS. 5 and 6 illustrate a bracket 70 and support block 80, respectively, that may be used to connect the principal components of a handrail system together. Holes 72, 74, and 82 are adapted to accept fasteners 90 to facilitate the assembly of the rail system. Angled surface portions 76 and 84 on bracket 70 and support block 80, respectively, allow component connections over a range of angles to accommodate different installation configurations, such as angled walkways, decks, or stairways. As a result, in an exemplary embodiment of the present invention, bracket 70 and support block 80 may be used for perpendicular as well as angled connections of a rail to a post or post cover 20. Thus, the versatility of bracket 70 and support block 80 eliminates the need for different components for perpendicular and angled connections, which may lead to additional benefits including, but not limited to, reduced manufacturing cost and installation time.

In the example of FIG. 5, angled surface portion 76 is at about a 45-degree angle relative to surface portion 78, through which holes 74 extend. Similarly, in the example of FIG. 6, angled surface portion 84 is at about a 45-degree angle relative to surface portion 86, through which holes 82 extend. Such as in this example, at least one hole 82 may extend through surface portion 84 to surface portion 86. As will be shown in subsequent figures, the angled configurations of the bracket 70 and support block 80 may facilitate connections of a rail to a post or post cover 20 over a range of angles. Although these exemplary embodiments of bracket 70 and support block 80 may be used for a 45-degree connection of a rail to a post or post cover 20, it should also be recognized that these exemplary components may be used to for other angled connections (e.g., less than or greater than 45 degrees) of a rail to a post or post cover 20. In addition, it should be recognized that other exemplary embodiments of the bracket and support block may have angled configurations that are less than or greater than 45 degrees and may also allow connections over a range of angles. In fact, in some exemplary embodiments of the present invention, the bracket and support block may not have angled configurations and may still allow for connections over a range of angles.

Figure 7:
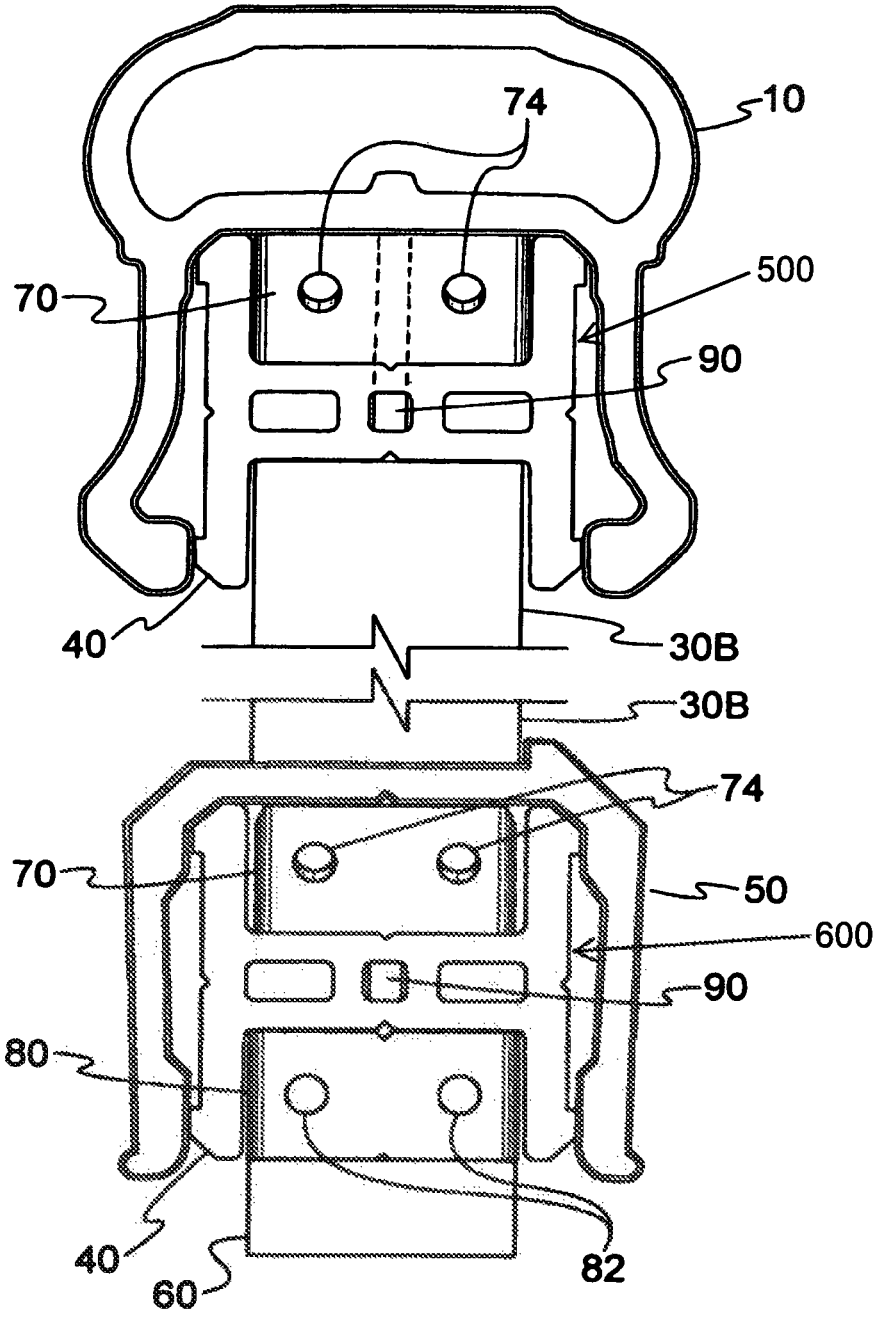
FIG. 7 is a partial, cross-sectional view of an exemplary installation of a rail system using at least some of the components of FIGS. 3A through 3K.

FIG. 7 illustrates one exemplary embodiment of component assembly for perpendicular or angled connections of rails to a post or post cover. In this example, support block 80 is used to support lower support rail 40. Holes 82 are provided so that the support block 80 may be secured to a post, a post cover, or any other desired support structure by fasteners. Optionally, a support block may also include other holes for receiving fasteners to secure the support block to a support rail. Brackets 70 may be similarly used to secure support rails 40 to a post, post cover, or any other desired support structure. In particular, fasteners may be inserted through holes 74 to secure brackets 70 to a support structure. In addition, although not visible in this view, fasteners may also be inserted through holes 72 to secure each bracket 70 to a support rail 40.

Support rails 40 provide a structural foundation upon which to attach top rail 10 and bottom rail 50. Each rail has a cavity that is adapted to receive a support rail 40. For example, such as shown in FIG. 7, each rail may have a cavity that is adapted to mate with a support rail 40. Upper rail 10 and lower rail 50 may simply be placed over respective support rails 40, which promotes a relatively easy installation. Fasteners 90 may be used to secure top rail 10 and bottom rail 50 to the respective support rails 40. As can be seen in FIG. 7, this configuration enables support rails 40, brackets 70, support block 80, and fasteners 90 to be substantially or totally obscured from view during normal use of the railing assembly. Moreover, in addition to the pleasing aesthetic appearance of the resulting railing assembly, this exemplary embodiment of the present invention provides a weather-resistant covering for the support components.

In the example of FIG. 7, each support rail 40 is oriented such that it has a generally H-shaped configuration. This orientation enables the brackets 70 and support block 80 to provide both perpendicular and angled connections of a rail over a range of angles, wherein the rail may be generally horizontal, if desired. As mentioned above, fasteners 90 may be used to secure top rail 10 and bottom rail 50 to respective support rails 40. Fasteners 90 may also be used to connect balusters 30B and squash block 60 to respective support rails 40. Additionally, alignment grooves 42, as illustrated in FIG. 3B, may be provided on support rail 40 to provide an easy and quick method of locating fasteners 90 along the centerline, if desired, of the support rail 40. For the same reason, bottom rail 50 may optionally include an alignment groove 52. Similarly, top rail 10 may include an alignment groove, if desired. Optionally, holes may also be provided in predetermined locations (e.g., in the alignment grooves 42 and 52) for the reception of fasteners 90. Such fastener holes may be pre-drilled or otherwise pre-formed before assembly, or such fastener holes may be drilled or otherwise formed during assembly.

Figure 8A:
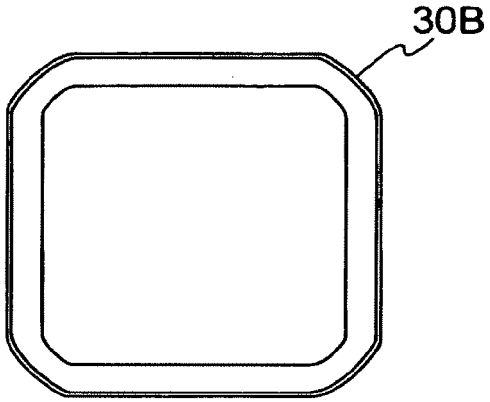
FIG. 8A is a cross-sectional view of an exemplary embodiment of a baluster of a rail system.
Figure 8B:
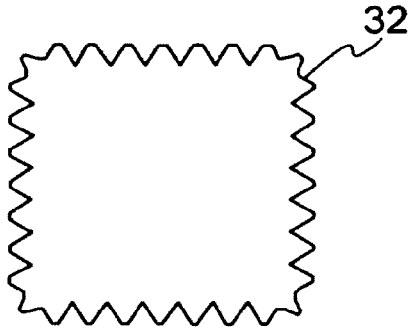
FIG. 8B is a cross-sectional view of an exemplary embodiment of a baluster plug.
Figure 8C:
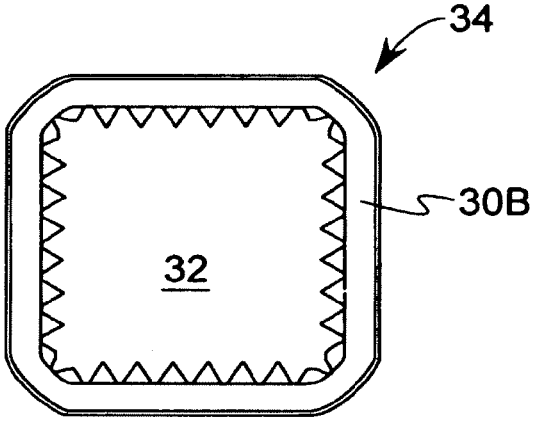
FIG. 8C is a cross-sectional view of the baluster of FIG. 8A with baluster plug of FIG. 8B installed.
Figure 8D:
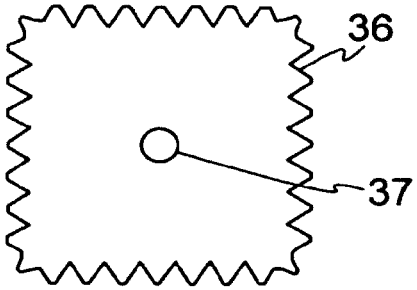
FIG. 8D is a cross-sectional view of an exemplary embodiment of a baluster plug with a hole.
Figure 8E:
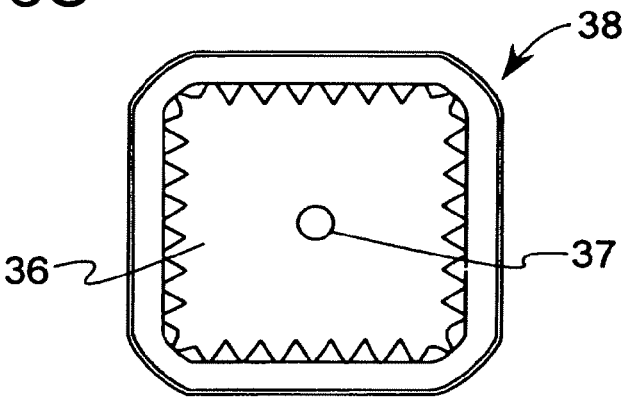
FIG. 8E is a cross-sectional view of an exemplary embodiment of a baluster with the baluster plug of FIG. 8D installed.

FIG. 8A illustrates a cross-sectional view of another exemplary embodiment of a baluster 30B, which may be a hollow tubular-like structure. FIG. 8B illustrates an example of an exemplary embodiment of a baluster plug 32, which optionally may comprise a grooved periphery to allow the application and retention of an adhesive or bonding agent. FIG. 8C illustrates a cross-sectional view of a baluster assembly 34 with may comprise a baluster 30B with a baluster plug 32 installed on at least one end portion of the baluster 30B. Alternatively, a single baluster plug 32 may extend the full length of the baluster 30B. In either case, the baluster plug or plugs 32 may be drilled before or after assembly within the baluster 30B to accommodate appropriate assembly fasteners 90. FIG. 8D depicts a baluster plug 36 comprising a pre-drilled or otherwise pre-formed fastener hole 37. For example, baluster plug 36 may be molded (e.g., extruded) such that it has fastener hole 37. FIG. 8E illustrates an example of a baluster assembly 38 that includes baluster plug(s) 36. It should be noted that the baluster 30B and baluster plugs 32 and 36 may be comprised of a plastic, plastic composite material, or any other similar or suitable material such as described herein and may be fabricated by molding, extrusion, or any other suitable process or method known to those skilled in the art. Furthermore, it should be recognized that exemplary embodiments of a squash block may also be comprised of components similar to the above-described baluster assemblies 34 and 38.

Figure 9:
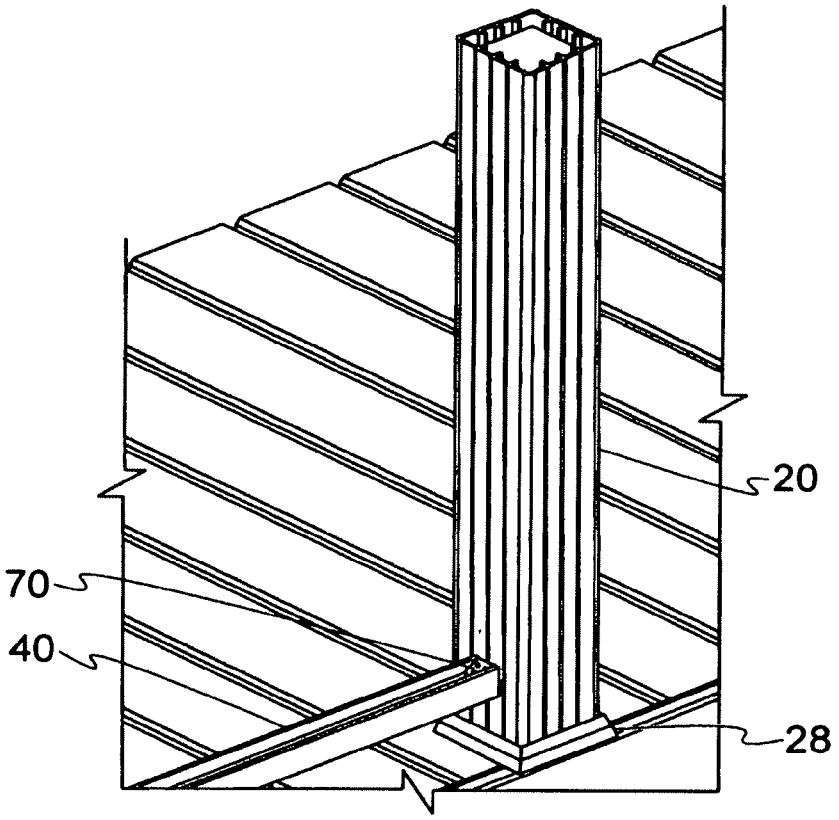
FIG. 9 is a partial perspective view of an exemplary embodiment of an installed lower support rail.
Figure 10:
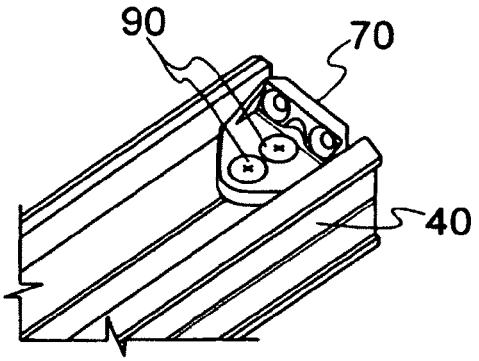
FIG. 10 is a partial perspective view illustrating an exemplary manner of attaching a bracket to a support rail.
Figure 11:
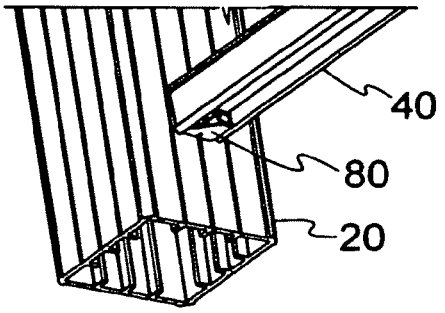
FIG. 11 is another partial perspective view of an exemplary embodiment of an installed lower support rail.

FIGS. 9 through 11 illustrate various views of an exemplary assembly configuration showing the installation of a lower support rail 40. In this example, support rail 40 is substantially perpendicular to post cover 20. As shown in the partial view of FIG. 11, support rail 40 rests on support block 80. Although FIG. 11 shows a straight rail configuration, it is evident that support block 80 would enable angled connections up to about 45 degrees in this example. In addition, as shown in FIGS. 9 and 10, a bracket 70 is used to secure support rail 40 to the post cover 20. In this exemplary configuration, fasteners 90 are aligned with the centerline of support rail 40.

Figure 12:
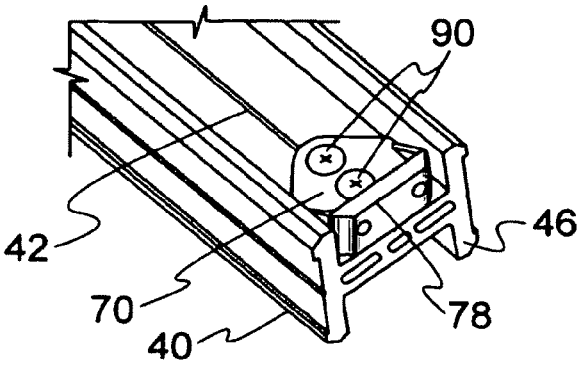
FIG. 12 is another partial perspective view illustrating an exemplary manner of attaching a bracket to a support rail.
Figure 13:
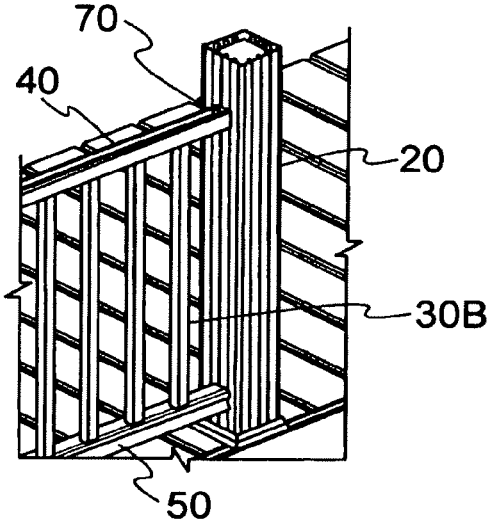
FIG. 13 is a partial perspective view of an exemplary manner of attaching a bottom rail and balusters to an upper support rail.

FIGS. 12 and 13 show in more detail the component relationship between a bracket and support rail in a straight rail configuration. As shown in FIG. 12, surface portion 78 of bracket 70 may be substantially aligned with edge 46 of support rail 40. Fasteners 90 may be inserted through holes 72 in bracket 70 to secure bracket 70 to support rail 40. Fasteners 90 may also be inserted through holes 74 in surface portion 78 in order to secure bracket 70 and support rail 40 to post cover 20. FIG. 13 shows lower rail 50 installed over lower support rail 40. FIG. 13 also shows the installation of balusters 30B and upper support rail 40. In an exemplary embodiment, balusters 30B may be pre-assembled between upper support rail 40 and lower rail 50 using fasteners 90 so that these components may be installed as a single unit to facilitate installation in the field. Prior to being fastened, balusters 30B may be spaced along the rail as desired.

In the example of FIG. 12, it should be note that the support rail 40 embodies an alignment groove 42, which provides a ready reference that may be used to easily locate fasteners 90 for securing bracket 70 to support rail 40. As previously noted, support rail 40 may be drilled or otherwise provided with holes to accommodate assembly fasteners 90. The alignment groove 42 may be embodied onto the surface of the support rail 40 by means of a groove during the manufacturing process, such as extrusion, or it may be subsequently applied by means of a marking method, such as through the use of marking inks, etching, or other methods known to those knowledgeable in the art.

Figure 14:
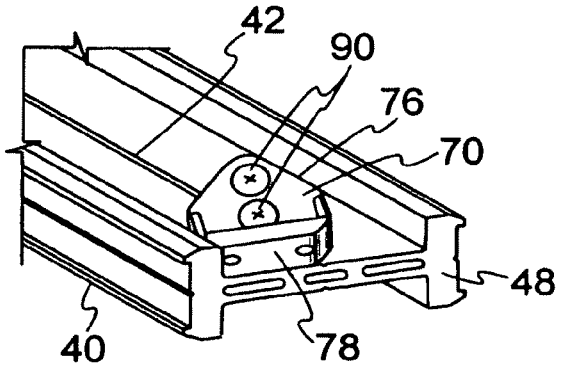
FIG. 14 is a partial perspective view of an exemplary manner of attaching a bracket to a support rail for an angled installation of a rail.
Figure 15:
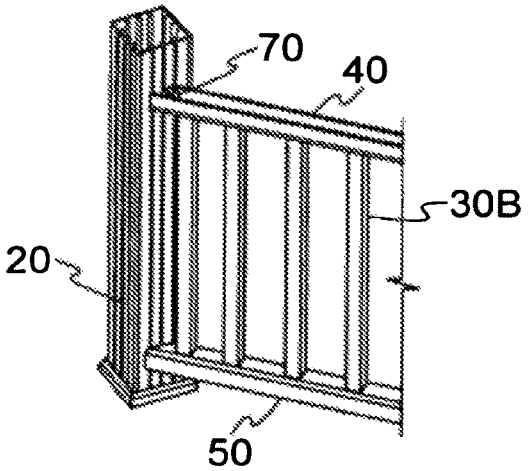
FIG. 15 is a partial perspective view of an exemplary manner of attaching a bottom rail and balusters to an upper support rail for an angled installation of a rail.

FIGS. 14 and 15 illustrate an example of how bracket 70 may be attached to support rail 40 for an angled rail installation. In this example, support rail 40 may be cut or formed in any other suitable manner such that it has an angled edge 48. The angle of edge 48 may be selected to provide the desired angular connection between the rail and post cover 20. Surface or face portion 78 of bracket 70 may be substantially aligned with angled edge 48 of support rail 40. Fasteners 90 may be inserted through holes 72 in bracket 70 in order to secure bracket 70 to support rail 40. As shown in this example, at least one of the holes 72 may aligned with optional alignment groove 42 in order to properly position bracket 70 on support rail 40. In other words, the center fastener is aligned with the alignment groove 42 in this example. As depicted in FIG. 15, angled edge 48 may be situated against post cover 20. Fasteners 90 may be inserted through holes 74 in surface portion 78 in order to secure bracket 70 and support rail 40 to post cover 20, thereby providing the desired angular connection. Lower rail 50 may have an edge that has an angle similar to that of edge 48, and it may be situated over lower support rail 40 as shown in FIG. 15. FIG. 15 also shows balusters 30B and upper support rail 40.

Figure 16:
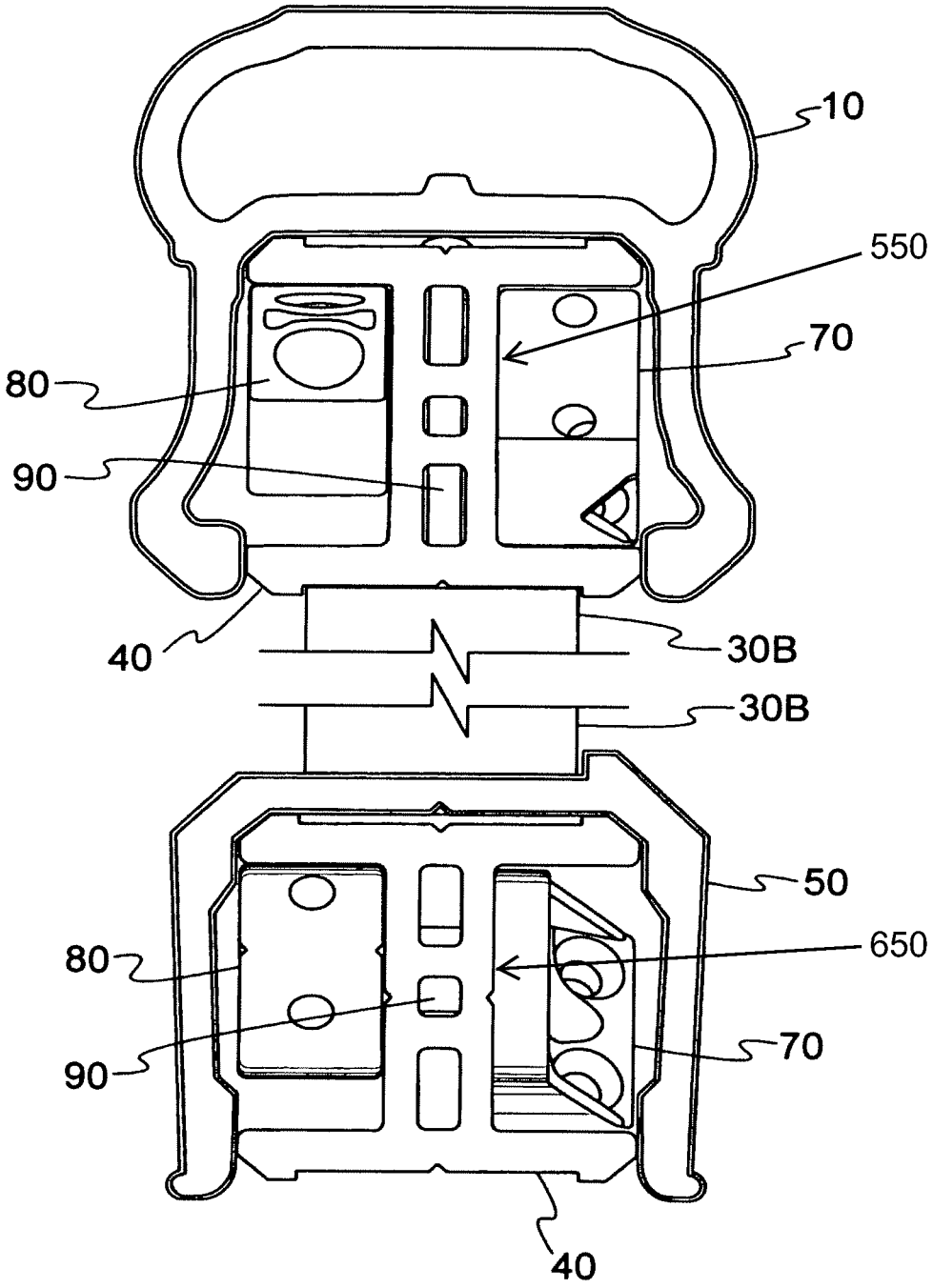
FIG. 16 is a partial, cross-sectional view of an exemplary installation of a rail system in a stair rail application.

FIG. 16 shows a different arrangement of the above-described components for applications requiring rails on changing elevations, for example, as in a stair rail. This configuration allows a rail to be connected to a support structure over a range of angles. As a result, this configuration may be used when a rail is supported at different levels, such as in a stair system or in any other system in which a rail is not level. Relative to the example shown in FIG. 7, support rails 40, brackets 70, and support blocks 80 are rotated about 90 degrees as shown in the example of FIG. 16. As a result, in this configuration, each support rail 40 is positioned such that it is substantially I-shaped. At least one of the support rails 40 is supported by a support block 80. Brackets 70 may be used in conjunction with fasteners 90 to effectively secure respective support rails 40 to a support structure, such as a post cover 20 or any other available support surface (e.g., a building wall). Fasteners 90 may also be used to secure support rail 40 to baluster 30B. Optionally, each support rail may have at least one alignment groove 44 to assist in aligning the support rail with baluster 30B. If desired, holes may also be provided in predetermined locations (e.g., in the alignment grooves 44 and 52) for the reception of fasteners 90. Such fastener holes may be pre-drilled or otherwise pre-formed before assembly, or such fastener holes may be drilled or otherwise formed during assembly.

Figure 17:
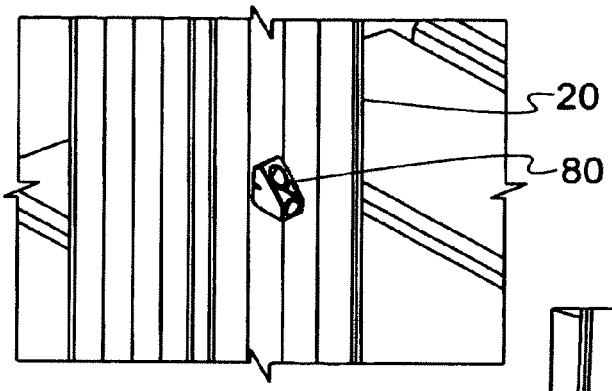
FIG. 17 is a partial perspective view illustrating an exemplary manner of attaching a support block to a post cover in a stair rail installation.
Figure 18:
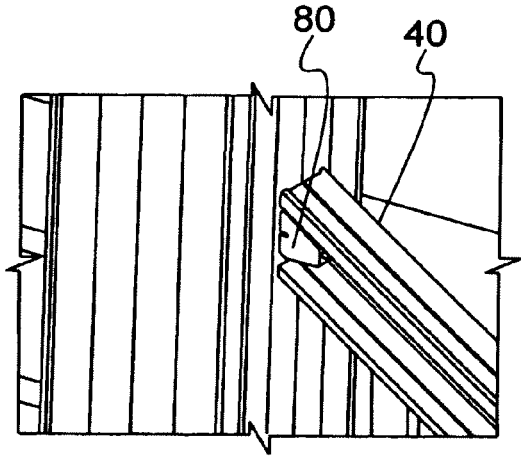
FIG. 18 is a partial perspective view illustrating an exemplary manner of attaching a support rail and support block to a post in a stair rail installation.
Figure 19:
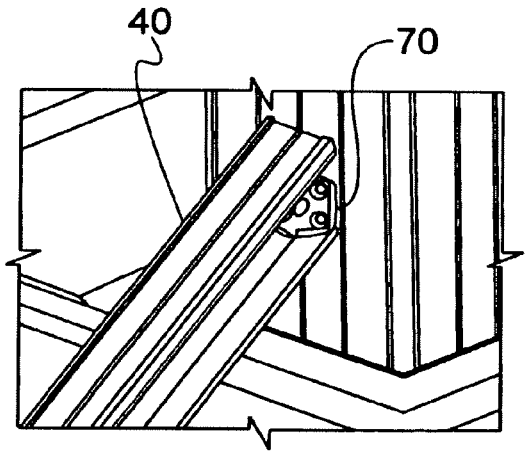
FIG. 19 is a partial perspective view illustrating an exemplary manner of attaching a support rail and bracket to a post in a stair rail installation.
Figure 20:
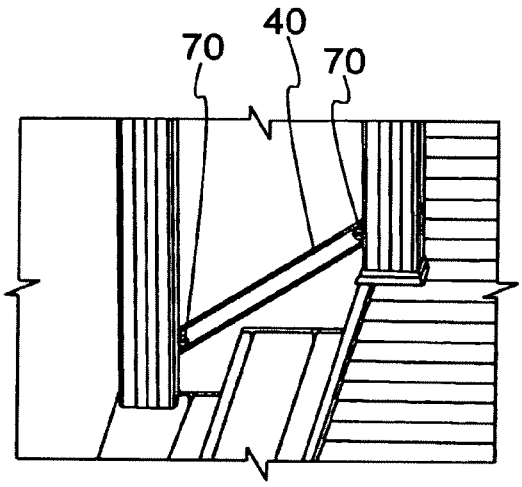
FIG. 20 is a partial perspective view illustrating an exemplary installation of a support rail between two posts in a stair rail application.

FIGS. 17 through 20 illustrate the component assembly relationships in an exemplary stair rail application requiring changes in rail elevation. As shown in FIG. 17, fasteners 90 may be inserted through holes 82 to secure support block 80 to post cover 20. FIG. 18 shows the subsequent positioning of a support rail 40 relative to support block 80. FIG. 19 depicts an exemplary attachment of a bracket 70 to a support rail 40. In an exemplary embodiment, bracket 70 may be pre-mounted to support rail 40 using fasteners 90. Fasteners 90 may also be inserted through holes 74 of bracket 70 to secure support rail 40 and bracket 70 to post cover 20. FIG. 20 illustrates an exemplary installation of a lower support rail 40 in a stair rail application.

Figure 21A:
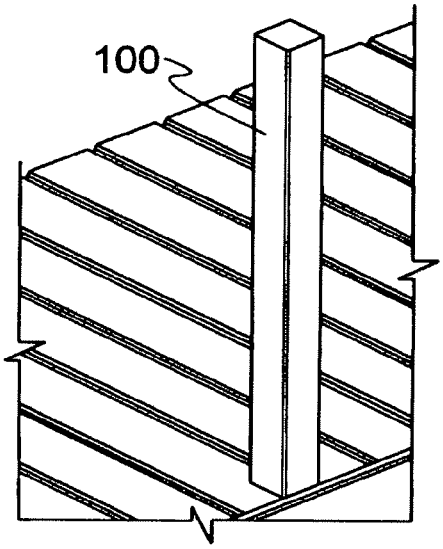
FIGS. 21A through 21H are partial perspective views illustrating a sequential step-by-step installation of an exemplary embodiment of a handrail system.
Figure 21B:
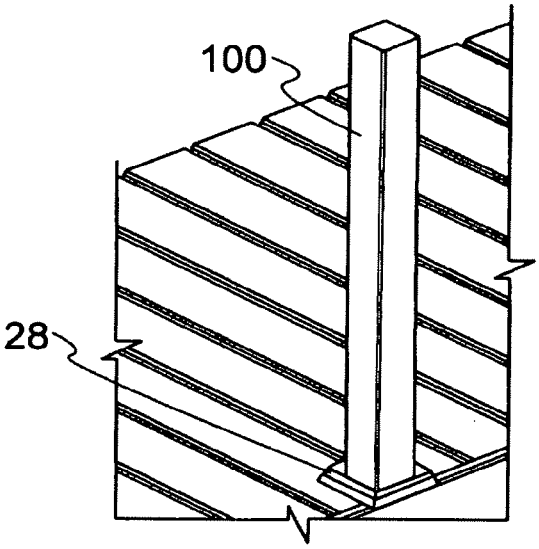
Figure 21C:
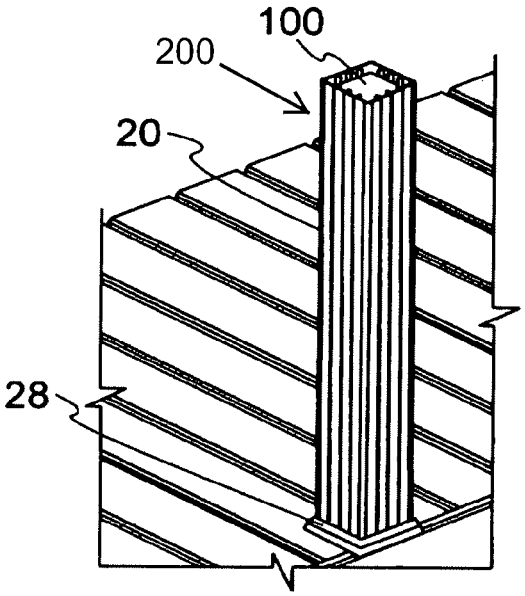
Figure 21D:
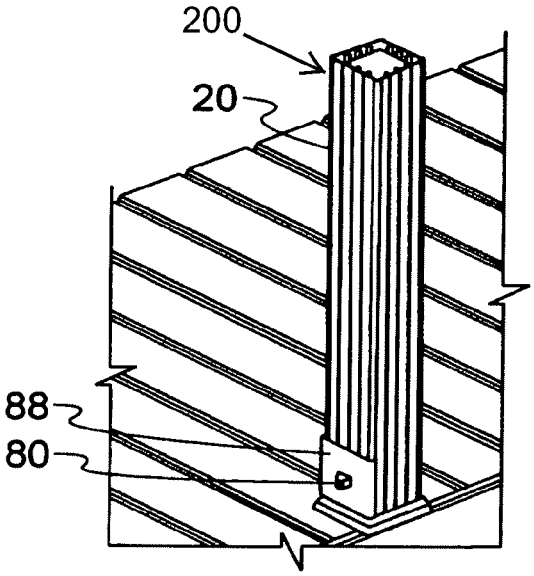
Figure 21E:
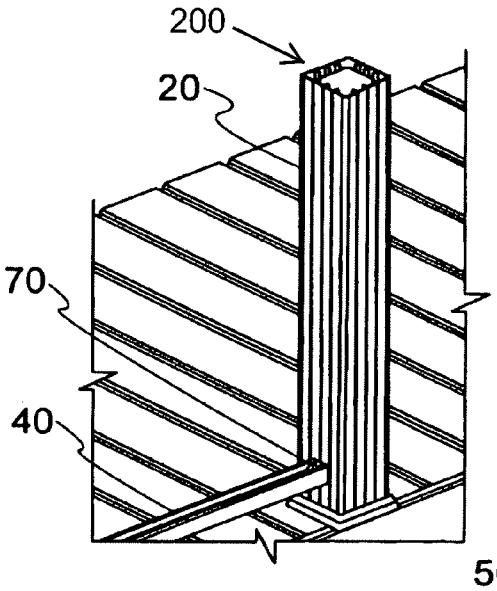
Figure 21F:
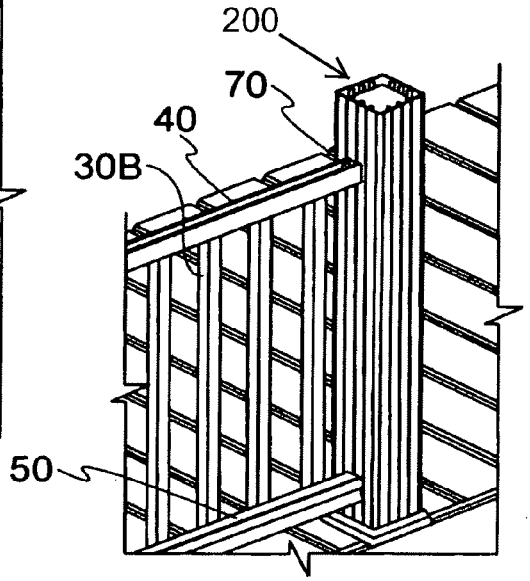
Figure 21G:
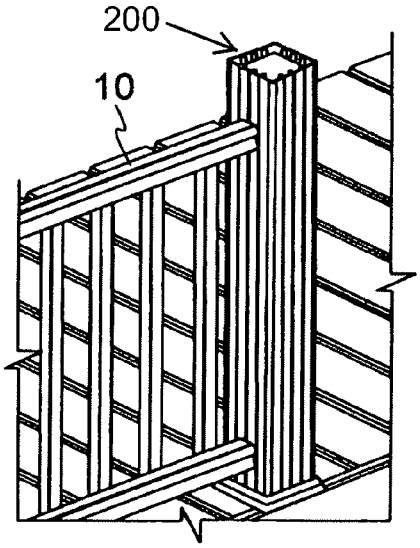
Figure 21H:
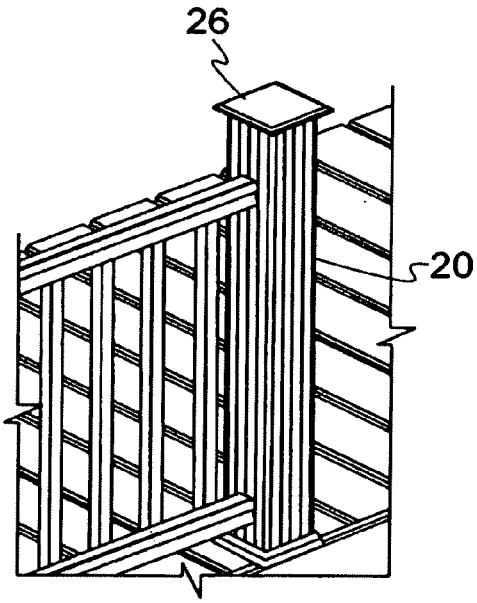

FIGS. 21A through 21H illustrate an exemplary set of sequential steps for an exemplary installation of this invention as a handrail guard. FIG. 21A depicts an installed post 100, which may be built, for example, on the perimeter of a residential deck. FIG. 21B illustrates the installation of a post skirt 28 around post 100. Post cover 20 is next installed over post 100, forming a rail post 200 and inserted into the post skirt 28 as shown in FIG. 21C. Support block 80 may be installed on the post cover 20 using an optional template 88 to assist with positioning, as shown in FIG. 21D. This optional template 88 may be placed on post skirt 28 to consistently position the support block 80 during installation and may be made of plastic, cardboard, metal, or any other suitable material. For convenience, it may be included as a "punch out" feature in the packaging for the railing components, or it may be supplied separately. If integrated into the packaging, it may be punched or cut out prior to or after the railing components have been removed from the packaging. In order to assist with positioning support block 80, an opening may be punched or cut out of template 88 for receiving support block 80, and the sides of template 88 may be folded such that template 88 wraps around opposing sides of post cover 20. In this exemplary embodiment, support block 80 is aligned with the centerline of post cover 20 for both angled and straight sections. Furthermore, support block 80 is oriented such that the angled edge is in the desired direction. FIG. 21E shows the placement of lower support rail 40 on support block 80 (not shown). Optionally, lower support rail 40 may be pre-assembled with at least one squash block 60, which may be secured with fasteners 90. In addition, bracket 70 may be secured to lower support rail 40 prior to placing lower support rail 40 on support block 80. After placing lower support rail 40 on support block 80, fasteners 90 may be used to secure bracket 70 and lower support rail 40 to post cover 20. Alternatively, lower support rail 40 may first be placed on support block 80, and then bracket 70 may be secured to lower support rail 40 and post cover 20 with fasteners 90. FIG. 21F next illustrates the installation of a lower rail 50, balusters 30B, and upper support rail 40. In an exemplary method, balusters 30B may first be secured between upper support rail 40 and lower rail 50 to form a sub-assembly. As can be seen in FIG. 3C, lower rail 50 may optionally include a protruding edge 54, which may provide a convenient alignment surface against which to mount balusters 30B. The sub-assembly may then be installed such that the lower rail 50 is positioned over lower support rail 40. In other exemplary installation methods, balusters 30B, upper support rail 40, and lower rail 50 may be installed individually or in various sub-combinations. It should be noted that a bracket 70 is installed on the upper support rail 40 and is subsequently connected to the post cover 20 to secure the rail assembly into position. FIG. 21G illustrates the installation of the upper rail 10, which may simply be placed over upper support rail 40. Fasteners 90 may subsequently be used to secure upper rail 10 to upper support rail 40. Lastly, FIG. 21H shows the installation of a finishing post cover cap 26 onto the post cover 20 to provide a weather-resistant barrier to the elements and provide a pleasing finished look to the rail system. For example, fasteners 90 may be inserted (e.g., screwed) upward through upper support rail 40 in order to engage and secure upper rail 10.

Figure 22A:
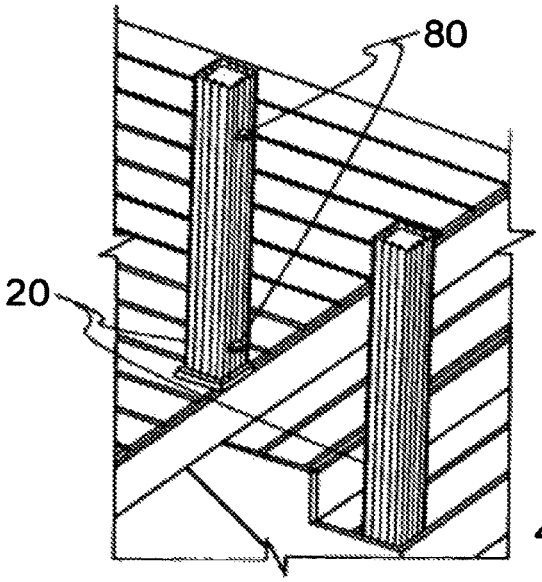
FIGS. 22A through 22D are partial perspective views illustrating a sequential step-by-step installation of an exemplary embodiment of a stair rail system.
Figure 22B:
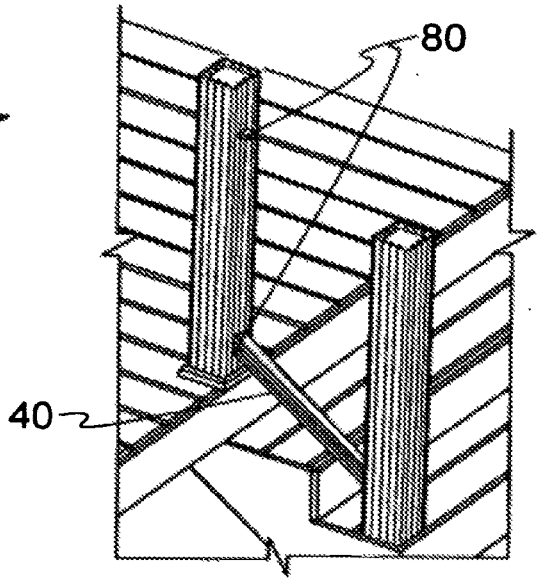
Figure 22C:
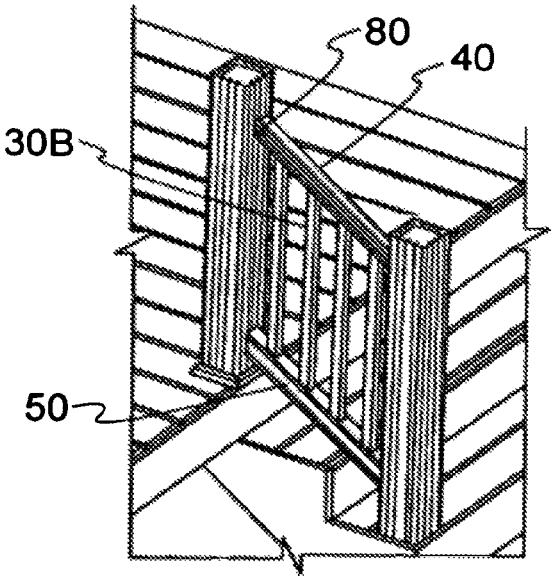
Figure 22D:
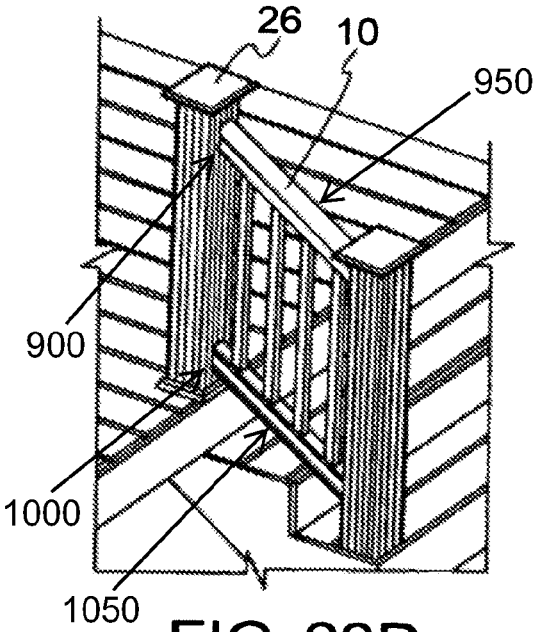

FIGS. 22A through 22D illustrate an exemplary set of sequential steps of an exemplary installation of this invention as a stair rail guard. FIG. 22A shows an installation of two post covers 20 and support blocks 80. As described above with regard to the handrail application, support blocks 80 may be positioned using an optional template or templates. FIG. 22B next shows an installation of a lower support rail 40, which is supported by a support block 80 on each post cover 20. Such as shown in FIG. 16 or FIG. 19, brackets 70 may be used to secure lower support rail 40 to each post cover 20. In an exemplary method, brackets 70 may be secured to lower support rail 40 prior to or during installation. FIG. 22C next shows the installation of balusters 30B, lower rail 50, and upper support rail 40. Balusters 30B may be cut, mitered, or otherwise formed to have angled edges suitable for this type of application. Similar to the above-described installation of a handrail, balusters 30B may first be secured between upper support rail 40 and lower rail 50 to form a sub-assembly. The sub-assembly may then be installed such that the lower rail 50 is positioned over lower support rail 40. In other exemplary installation methods, balusters 30B, upper support rail 40, and lower rail 50 may be installed individually or in various sub-combinations. Again, it should be noted that a bracket 70 is installed on the upper support rail 40 and is subsequently connected to the post cover 20 to secure the rail assembly into position. Finally, FIG. 22D shows the installation of the upper rail 10 and post cover caps 26 to complete an exemplary stair rail assembly.

The foregoing examples demonstrate how various angled connections may be formed. FIG. 7 shows a top support rail received by a top rail in a first position 500 as well as a bottom support rail received by a bottom rail in a first position 600. Conversely, FIG. 16 shows a top support rail received by a top rail in a second position 550 as well as a bottom support rail received by a bottom rail in a second position 650. FIG. 4 shows an example of an angled connection 700 between a top support rail and a support structure in a first plane 750. FIG. 4 also shows an example an angled connection 800 between a bottom support rail and a support structure in a first plane 850. FIGS. 9-15 and 21E-21H show further examples of how to make angled connections in a first plane (e.g., a horizontal plane in these examples as well as FIG. 4 for a deck rail). In particular, FIG. 15 shows a different example of an angled connection in a horizontal plane. On the other hand, FIG. 22D shows an example of an angled connection 900 between a top support rail and a support structure in a second plane 950. FIG. 22D also shows an example an angled connection 1000 between a bottom support rail and a support structure in a second plane 1050. FIGS. 19, 20, and 22B-22C show examples of how to make angled connections in a second plane (e.g., a vertical plane in these examples as well as FIG. 22D for a stair rail).

Unless expressly claimed otherwise, a component of the present invention may be made from any suitable material. Although many materials may be used to fabricate the components disclosed in this invention, one exemplary embodiment may employ composite material that may be resistant to weathering and easily integrated into structures, such as railing. In one exemplary embodiment, a capstock layer (e.g., a PVC capstock layer) may be placed over a composite substrate to form an upper rail 10, support rail 60, bottom rail 50, squash blocks 60, balusters 30A, post covers 20, and ancillary components, such as post skirts 28 and caps 26, thereby providing a system of components that may be easily assembled into a rail. The capstock layer may be comprised of PVC, which may be placed over the composite substrate by any suitable fabrication method, such as co-extrusion, compression molding, injection molding, or other similar or suitable methods. The capstock layer and base material combination may allow lower cost, less attractive, and structurally rigid materials to be used as a base framework upon which an attractive and protective PVC capstock layer may be applied. Nevertheless, it should be recognized that other suitable materials may be used such as, but not limited to, wood, metal, composites, plastics, and other similar or suitable materials.

In one exemplary embodiment of the present invention, a substrate may be comprised of a composite that has a high cellulosic content. In particular, the composite may be comprised of cellulosic material in the amount of at least about 50% by weight and a plastic material in an amount of up to about 50% by weight. For instance, in one exemplary embodiment, the composite may be comprised of cellulosic material in the amount of about 55% by weight and a plastic material in an amount of about 45% by weight. In yet another exemplary embodiment, the composite may be comprised of cellulosic material in the amount of about 60% by weight and a plastic material in an amount of about 40% by weight.

The high cellulosic content enables the cost-effective production of a substrate that has desirable structural characteristics. For example, the high cellulosic content promotes the desired durability, rigidity, flexibility, and other structural characteristics for a variety of types of components. For instance, the high cellulosic content may enable the cost-effective production of railing components that exceed load testing requirements.

The cellulosic material may be virgin or recycled. Examples of cellulosic material include sawdust, newspapers, alfalfa, wheat pulp, wood chips, wood fibers, wood particles, ground wood, wood flour, flax, wood flakes, wood veneers, wood laminates, paper, cardboard, straw, cotton, rice hulls, coconut shells, peanut shells, bagasse, plant fibers, bamboo fiber, palm fiber, kenaf, and other similar, suitable, or conventional materials. Any of the wood examples may be hard or soft wood or variations thereof. Furthermore, any desired mesh size of the cellulosic material can be used. With regard to wood flour, an exemplary range of mesh size is about 10 to about 100 mesh, more preferably about 20 mesh to about 80 mesh depending on the desired characteristics of the composite.

The cellulosic material may be dried to a desired moisture content prior to or during the formation of the base layer. For example, the cellulosic filler(s) may be dried to about 0.5% to about 3% moisture content by weight, more preferably to about 1% to about 2% moisture content by weight. However, it should be recognized that the cellulosic material may have a moisture content less than about 0.5% by weight or greater than about 3% by weight and still be within the scope of the present invention.

The plastic material may be comprised of virgin or recycled materials that may improve the characteristics of the reinforced composite and/or enhance the manufacture or moldability thereof. In an exemplary embodiment of the present invention, the plastic material is a PVC material, which enables the production of a component having structural characteristics suitable for railing or other structurally demanding applications. The PVC material may, for example, be made by mixing PVC resin with, optionally, at least one stabilizer, at least one lubricant, at least one process aid, and other optional ingredients (e.g., acrylic modifier, inorganic filler, and other suitable additives). Optionally, another plastic resin may also be included in the composite such as, but not limited to, acrylonitrile butadiene styrene (i.e., ABS) resin. An example of a mixer is a high intensity mixer such as those made by Littleford Day Inc. or Henschel Mixers America Inc. As an example, the mechanically induced friction may heat the ingredients to a temperature between about 200° F. and about 230° F. After mixing, the ingredients may be cooled to ambient temperature. Alternatively, the ingredients of the PVC material may be mixed together during the formation of the base layer.

With reference to a plastic material that comprises PVC resin, the plastic material may include stabilizer(s) in an amount of about 1 to about 10 parts, more preferably about 2 to about 4 parts, per 100 parts of the PVC resin. The lubricant(s) may be present in an amount of about 2 to about 12 parts, more preferably about 4 to about 11 parts, per 100 parts of the PVC resin. Also, process aid(s) may be included in an amount of about 0.5 to about 8 parts, more preferably about 0.7 to about 3 parts, per 100 parts of the PVC resin. Optionally, acrylic modifier(s) (e.g., impact modifiers) may be present in an amount of about 1 to about 10 parts, more preferably about 4 to about 8 parts, per 100 parts of the PVC resin. As a further option, inorganic filler(s) may be added in an amount of up to about 10 parts, more preferably about 3 to about 9 parts, per 100 parts of the PVC resin. In addition, another plastic resin (e.g., ABS resin or any other similar or suitable resin) may be included in an amount up to about 50% by weight of the composite, more preferably about 5-10% by weight of the composite.

Stabilizer(s) may be employed to limit or prevent the breakdown of the plastic material during molding. Examples of stabilizers include tin stabilizers, lead and metal soaps such as barium, cadmium, and zinc, and other similar or suitable materials.

Internal or external lubricant(s) may aid in the molding process. Lubricants may be added to the plastic material to assist the reinforced composite through an extruder, compounder, or other molding machine, and to help facilitate mold release. Examples of lubricants include zinc stearate, calcium stearate, esters, amide wax, paraffin wax, ethylene bis-stearamide, and other similar or suitable materials.

Process aid(s) may aid in the fusion of the compound. Examples of process aids include acrylic process aids and other similar or suitable materials for improving the fusion of the compound. R&H K-120N and R&H K-175 are examples of acrylic process aids that are available from Rohm & Haas.

Acrylic modifier(s) may improve the physical characteristics of the compound. One example of an impact modifier is Arkema P530. Another example of an acrylic modifier is R&H K-400, which is available from Rohm & Haas. Although R&H K-400 is a high molecular weight acrylic modifier that is specifically designed for PVC foam applications, the inventors have discovered that it may also improve the physical characteristics of the base layer of the present invention, which has a high cellulosic content and may not include any foaming or blowing agents.

Inorganic filler(s) may be used to increase the bulk density of the reinforced composite. The use of inorganic filler may also improve the ability to process the reinforced composite, thereby allowing for higher rates of manufacture (e.g., extrusion). Inorganic filler may also allow the reinforced composite to be molded into articles having reduced moisture sensitivity and reduced flame and smoke spread. Examples of inorganic fillers include talc, calcium carbonate, kaolin clay, magnesium oxide, titanium dioxide, silica, mica, barium sulfate, wollastanite, acrylics, and other similar or suitable materials.

Other optional ingredients that may be included in the PVC material include, but are not limited to, polymers, plastics, thermoplastics, rubber, cross-linking agents, accelerators, inhibitors, enhancers, blowing agents/foaming agents, compatibilizers, thermosetting materials, pigments, weathering additives, and other similar or suitable materials.

Blowing agent(s) may be used to reduce the cost (e.g., by reducing the amount of polymer used in the composite) and weight of the composite material. A blowing agent may be an endothermic or exothermic blowing agent. An example of a chemical endothermic blowing agent is Hydrocerol BIH (i.e., sodium bicarbonate/citric acid), which is available from Clariant Corp., whereas an example of a chemical exothermic foaming agent is azodicarbonamide, which is available from Uniroyal Chemical Co.

The use of thermosetting materials may, for example, reduce moisture absorption and increase the strength of products manufactured from the reinforced composite material. Examples of thermosetting materials include polyurethanes (e.g., isocyanates), phenolic resins, unsaturated polyesters, epoxy resins, and other similar or suitable materials. Combinations of the aforementioned materials are also examples of thermosetting materials.

Pigments may be used to give the composite a desired color (e.g., white, cedar, gray, and redwood). Examples of pigments include titanium dioxide, iron oxide, and other similar or suitable colorant additives.

Titanium dioxide is also an example of a weathering additive. Other similar or suitable weathering additives include, but are not limited to, other ultraviolet absorbers. Examples of other ultraviolet absorbers include organic chemical agents such as benzophenone and benzotriazole types.

Due to the high cellulosic content of some exemplary embodiments, a base layer may not provide the desired aesthetic characteristics. As a result, the present invention may provide a capstock layer on the base layer. The capstock layer is preferably comprised of PVC. The use of a capstock layer may enable lower cost, less attractive, yet structurally desirable materials that have a high cellulosic content to be used as the base framework. For instance, the capstock layer may be applied on the base layer to provide an attractive and protective finish for the component. For example, the capstock layer may be provided in any desired color (e.g., to match the appearance of a deck or building exterior), and it may have a smooth outer surface or a pattern or texture formed on its outer surface.

FIGS. 1 and 2 show examples in which a capstock layer covers the entire exterior surface of the profile. If desired, a capstock layer may also be applied on the interior surface of the profile. It should also be recognized that a capstock layer may only cover a limited portion of the interior or exterior surface of the base layer in certain embodiments of the present invention.

A component of the present invention may be manufactured using any suitable manufacturing techniques. For example, a base layer and a capstock layer may be co-extruded. Alternatively, the capstock layer may be applied on the base layer (or vice versa) in a sequential extrusion process. Other molding techniques including, but not limited to, injection molding and compression molding may be used to manufacture a component of the present invention. In addition, it should be recognized that the optional layers of a component may be formed separately and then joined then in a subsequent process, such as with the use of adhesives or other suitable bonding materials.

EXAMPLES

One example of a composite that may be used to make a component comprises ingredients in the following amounts:

| INGREDIENT | PARTS PER 100 PARTS OF RESIN | WEIGHT PERCENT |
|---|---|---|
| wood flour | 150 | 55.1 |
| PVC resin | 100 | 36.8 |
| lubricant | 7.5 | 2.8 |
| acrylic modifier | 6 | 2.2 |
| calcium carbonate | 5 | 1.8 |
| tin stabilizer | 2.5 | 0.9 |
| process aid | 1 | 0.4 |

Another example of a composite that may be used to make a component comprises ingredients in the following amounts:

| INGREDIENT | PARTS PER 100 PARTS OF RESIN | WEIGHT PERCENT |
|---|---|---|
| wood flour | 183 | 60 |
| PVC resin | 100 | 32.8 |
| lubricant | 7.5 | 2.5 |
| acrylic modifier | 6 | 2 |
| calcium carbonate | 5 | 1.6 |
| tin stabilizer | 2.5 | 0.8 |
| process aid | 1 | 0.3 |

A third example of a composite that may be used to make a component comprises ingredients in the following amounts:

| INGREDIENT | PARTS PER 100 PARTS OF RESIN | WEIGHT PERCENT |
|---|---|---|
| wood flour | 146.6 | 50.0 |
| PVC resin | 100 | 34.1 |
| ABS resin | 18.4 | 6.3 |
| thermal stabilizer | 3.75 | 1.3 |
| lubricant | 10 | 3.4 |
| impact modifier | 6.0 | 2.1 |

-continued

| INGREDIENT | PARTS PER 100 PARTS OF RESIN | WEIGHT PERCENT |
|---|---|---|
| process aid | 1 | 0.3 |
| calcium carbonate | 7.5 | 2.6 |

A fourth example of a composite that may be used to make a component comprises ingredients in the following amounts:

| INGREDIENT | PARTS PER 100 PARTS OF RESIN | WEIGHT PERCENT |
|---|---|---|
| wood flour | 179.3 | 55.0 |
| PVC resin | 100 | 30.7 |
| ABS resin | 18.4 | 5.7 |
| thermal stabilizer | 3.75 | 1.2 |
| lubricant | 10 | 3.1 |
| impact modifier | 6.0 | 1.8 |
| process aid | 1 | 0.3 |
| calcium carbonate | 7.5 | 2.3 |

A fifth example of a composite that may be used to make a component comprises ingredients in the following amounts:

| INGREDIENT | PARTS PER 100 PARTS OF RESIN | WEIGHT PERCENT |
|---|---|---|
| wood flour | 220 | 60.0 |
| PVC resin | 100 | 27.3 |
| ABS resin | 18.4 | 5.0 |
| thermal stabilizer | 3.75 | 1.0 |
| lubricant | 10 | 2.7 |
| impact modifier | 6.0 | 1.6 |
| process aid | 1 | 0.3 |
| calcium carbonate | 7.5 | 2.1 |

While specific examples of materials may be given for making the components of the present invention, it should again be recognized that the present invention is not limited to the use of any particular materials unless expressly claimed otherwise.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A rail system comprising:

a rail comprising a hollow upper portion, a pair of opposing legs that extend downward from said hollow upper portion to form a lower cavity, and a partition between said hollow upper portion and said lower cavity that extends from one of said opposing legs to the other of said opposing legs such that said lower cavity is defined between said opposing legs and underneath said partition; and a support rail having an H-shaped configuration comprised of two vertical members and two transverse members that respectively connect said two vertical members, said support rail positioned in said lower cavity completely between said opposing legs and completely beneath said partition of said rail such that said support rail is secured to said rail by at least one fastener that extends through said two transverse members of said support rail into said partition of said rail.

2. The rail system of claim 1 wherein each of said opposing legs of said rail has a distal portion that extends in a distal direction outwardly away from said opposing leg and then extends back toward said opposing leg.

3. The rail system of claim 1 wherein said partition of said rail comprises a substantially level mid-portion and angled portions that extend downward from respective ends of said mid-portion toward said opposing legs.

4. The rail system of claim 3 wherein said rail is positioned on said support rail where said angled portions extend from said mid-portion of said partition.

5. The rail system of claim 1 wherein each of said opposing legs of said rail has a distal end that is adjacent to a bottom end of one of said two vertical members of said support rail, respectively.

6. The rail system of claim 1 wherein said at least one fastener is adapted to be substantially or totally obscured from view by said rail during normal use of said rail system.

7. The rail system of claim 1 further comprising a bracket positioned between said support rail and said rail such that said bracket is adapted to secure said support rail to a support structure.

8. The rail system of claim 7 wherein said bracket is adapted to be substantially hidden from view between one of said transverse members of said support rail and said rail when said support rail is secured to said support structure during normal use of said rail system.

9. The rail system of claim 7 wherein said bracket is secured to said support rail by at least one fastener that extends through said bracket and at least one of said transverse members of said support rail.

10. The rail system of claim 9 wherein said at least one fastener that secures said bracket is adapted to be substantially or totally obscured from view by said rail when said support rail is secured to said support structure during normal use of said rail system.

11. The rail system of claim 1 further comprising at least one baluster that is positioned in a lower cavity defined by said support rail beneath said transverse members.

12. The rail system of claim 11 wherein said baluster is secured to said support rail by a fastener that extends through said transverse members into said baluster.

13. The rail system of claim 12 wherein said fastener that secures said baluster is adapted to be substantially hidden from view between one of said transverse members of said support rail and said rail during normal use of said rail system.

14. The rail system of claim 11 further comprising a bracket, said bracket positioned between said support rail and said rail in an upper cavity defined by said support rail above said transverse members such that said bracket is adapted to secure said support rail to a support structure.

15. The rail system of claim 11 further comprising a second rail such that said at least one baluster extends between said support rail and said second rail when installed.

16. The rail system of claim 15 wherein:

said baluster is secured to said support rail by a first fastener that extends through said transverse members into said baluster; and said baluster is secured to said second rail by a second fastener that extends through said second rail into said baluster.

17. The rail system of claim 16 wherein:

said first fastener is adapted to be substantially hidden from view between one of said transverse members of said support rail and said rail during normal use of said rail system; and said second fastener is adapted to be substantially or totally obscured from view by said second rail during normal use of said rail system.

18. The rail system of claim 1 further comprising:

at least one baluster that extends from said support rail; and a second rail having a top surface and a pair of opposing legs that extend downward from said top surface, said top surface defining a protruding edge that facilitates alignment of said at least one baluster with said second rail.

19. The rail system of claim 18 wherein said baluster is secured to said second rail by a fastener that extends through said second rail and into said baluster.

20. The rail system of claim 19 wherein said fastener that secures said baluster is adapted to be substantially or totally obscured from view by said second rail during normal use of said rail system.

21. The rail system of claim 1 further comprising:

a post cover comprising:

1) a plurality of sides such that said post cover is configured to extend completely around a post; and 2) a plurality of ribs that extend inwardly in a perpendicular direction from each of said sides such that each of said sides is associated with multiple said ribs; and a bracket positioned between said support rail and said rail such that said bracket secures said support rail to said post cover.

22. The rail system of claim 1 further comprising a bracket positioned between said support rail and said rail for securing said support rail to a support structure, said bracket having an angled surface portion configured to allow different angled connections of said support rail to said support structure to accommodate different installation configurations.

23. The rail system of claim 22 wherein said bracket is configured to allow a perpendicular connection and at least one other angled connection to said support structure.

24. The rail system of claim 22 wherein said angled surface portion extends at an angle of about 45° relative to a surface portion of said bracket that is adapted to be adjacent to said support structure when installed.

* * * * *